US006930293B2

(12) United States Patent
Matsuo et al.

(10) Patent No.: US 6,930,293 B2
(45) Date of Patent: Aug. 16, 2005

(54) INDUCTION HEATING APPARATUS, HEAT FIXING APPARATUS AND IMAGE FORMING APPARATUS

(75) Inventors: Shimpei Matsuo, Tokyo (JP); Hiroshi Mano, Shizuoka (JP); Minoru Hayasaki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 88 days.

(21) Appl. No.: 10/356,480

(22) Filed: Feb. 3, 2003

(65) Prior Publication Data

US 2003/0155349 A1 Aug. 21, 2003

(30) Foreign Application Priority Data

Feb. 4, 2002 (JP) ..... 2002-027175
May 29, 2002 (JP) ..... 2002-155234

(51) Int. Cl.[7] ..... H05B 6/08
(52) U.S. Cl. ..... 219/664; 219/667
(58) Field of Search ..... 219/664, 667, 219/619, 665, 668, 672, 660; 399/69, 328, 329–331, 320, 333–335

(56) References Cited

U.S. PATENT DOCUMENTS 4,467,165 A * 8/1984 Kiuchi et al. ..... 219/664
4,900,884 A * 2/1990 Aoki ..... 219/601
5,274,402 A 12/1993 Serizawa et al. ..... 346/160
5,412,480 A 5/1995 Serizawa et al. ..... 358/296
5,512,929 A 4/1996 Serizawa et al. ..... 347/153
5,794,096 A 8/1998 Okabayashi ..... 399/33
5,801,359 A 9/1998 Mano et al. ..... 219/667
5,819,150 A 10/1998 Hayasaki et al. ..... 399/330
5,940,655 A 8/1999 Sano et al. ..... 399/69
6,246,843 B1 6/2001 Nanataki et al. ..... 399/45
6,346,800 B1 2/2002 Mano et al. ..... 323/282
6,359,269 B1 3/2002 Hayasaki et al. ..... 219/665
6,373,232 B1 4/2002 Mano et al. ..... 323/282
6,438,335 B1 * 8/2002 Kinouchi et al. ..... 399/67
6,507,008 B2 * 1/2003 Nakayama et al. ..... 219/619
2002/0005405 A1 1/2002 Sato et al. ..... 219/667

FOREIGN PATENT DOCUMENTS

JP 51-109739 9/1976
JP 9-120221 5/1997
JP 10-301442 11/1998
JP 2000-245161 9/2000

* cited by examiner

*Primary Examiner*—Quang T. Van
(74) *Attorney, Agent, or Firm*—Fitzpatrick, Cella, Harper & Scinto

(57) ABSTRACT

An induction heating apparatus for a fixing device of an image forming apparatus includes a rectifying circuit for rectifying a commercial power supply, an excitation coil, a switching element for switching the supply of the output of the rectifying circuit to the excitation coil, and a switching signal output unit for outputting a switching signal for the switching element thereby supplying the excitation coil with a high frequency current.

The invention limits a current supply time to the excitation coil in such a manner that the maximum output for induction heating is set according to the commercial power supply voltage, thereby reducing the first print time without a power consumption in excess of the rating.

28 Claims, 16 Drawing Sheets

SUPPLYABLE CURRENT UPPER LIMIT AND POWER UPPER LIMIT IN THE CASE OF 15A RATING CORD

SUPPLYABLE CURRENT UPPER LIMIT AND POWER UPPER LIMIT IN THE CASE OF 15A RATING CORD

SUPPLYABLE CURRENT UPPER LIMIT AND POWER UPPER LIMIT IN THE CASE OF 15A RATING CORD

INDUCTION HEATING APPARATUS, HEAT FIXING APPARATUS AND IMAGE FORMING APPARATUS

BACKGROUND OF THE INVENTION

1. Field of the Invention

The present invention relates to an induction heating apparatus employing an inverter power source for effecting a heating process by induction heating, a heat fixing apparatus for heat fixing an unfixed toner image formed on a sheet, to such sheet utilizing such induction heating apparatus, and an image forming apparatus such as an electrophotographic apparatus or an electrostatic recording apparatus provided with such induction heat fixing apparatus.

2. Related Background Art

In an image forming apparatus, a fixing apparatus of a heat roller type has been widely employed in order to fix an unfixed image (toner image) of desired image information, formed by a direct method or an indirect method on a recording material (a transfer sheet, an electrofax sheet, an electrostatic recording paper, an OHP sheet, a printing paper or a formatted paper) in a process unit of a suitable image forming process such as an electrophotographic process, an electrostatic recording process or a magnetic recording process, as a permanent fixed image onto such recording material. In recent years, an apparatus of belt (film) heating type has also been commercialized for achieving a quick start or an energy saving. Also there is proposed an apparatus of electromagnetic induction heating system.

Among these, the present invention can be advantageously applied to the fixing apparatus of the induction heating type. In the induction heating fixing apparatus, an alternating magnetic flux (high frequency magnetic field) generated by magnetic field generating means is applied to an electromagnetic induction heat generating member, serving as a heat generating member, thereby inducing an eddy current therein and generating a Joule's heat by the resistance thereof, and the unfixed toner image is fixed by such generated heat to the surface of the recording material as a permanent fixed image.

Japanese Utility Model Application Laid-open No. 51-109739 discloses an induction heating fixing apparatus in which a current is induced in a fixing roller by a magnetic flux thereby generating a Joule's heat. Such apparatus can directly heat the fixing roller by utilizing generation of an induction current, thereby achieving a fixing process of a higher efficiency than in a fixing apparatus of heat roller type utilizing a halogen lamp as the heat source.

In a prior induction heating apparatus provided with an inverter power source, which supplies an exciting coil with a current by turning on and off a rectified output of a commercial power supply thereby executing induction heating of a heated member to a predetermined temperature, a power control signal is generated based on a comparison of a detected temperature of the heated member and a target temperature, and the temperature control is achieved by regulating a current supply interval of the excitation coil according to thus generated power control signal thereby controlling the amount of heat generation.

In the above-described configuration, since the voltage of the commercial power supply is supplied, without stabilization, directly to a load of a macroscopically constant resistance by on/off operation of the switch, the input electric power increases almost proportionally to the square of the input voltage. Therefore, in the above-explained temperature control method, the maximum supplied power varies significantly by the input voltage and the fluctuation in the start-up time becomes larger than in the halogen heater, in case of employing the commercial power supply showing a large voltage fluctuation range.

In order to prevent the change in the maximum supplied power resulting from the fluctuation in the input voltage, Japanese Patent Application Laid-open No. 9-120221 proposes an induction heating apparatus which detects the power supply voltage and executes a control of regulating the current supply interval according to a result of comparison with a reference voltage, thereby providing a substantially constant maximum supplied power regardless of a fluctuation in the power supply voltage.

Also, in order to correct not only the influence of an external fluctuation factor such as the power supply voltage but also the influence of an internal factor or a load variation, such as a rush current at a cold start-up operation, Japanese Patent Application Laid-open No. 10-301442 proposes an induction heating apparatus which detects also a current flowing in the load, and calculates a supplied power from the result of such detection and that of the power supply voltage detection means, thereby setting the maximum supplied power.

However, in the method proposed in Japanese Patent Application Laid-open No. 10-301442, as it becomes necessary to detect the power supply voltage and the current in the circuit of the primary side and to transmit these values for processing to the circuit of the secondary side where a temperature control unit is provided, there are required expensive components such as a photocoupler or a transformer in plural units, whereby the cost becomes inevitably high.

Also in any of the aforementioned related technologies, there is always set a constant maximum supplied power over a voltage range of the commercial power supply. However, as shown in FIG. 14, the upper limit of the usable current (1503, 1504) for the rated current value varies depending on the regional safety regulations, so that the usable power (1505, 1507) varies for each regional voltage range, and a upper limit line (1506, 1508) of the power usable in the induction heating apparatus, obtained by subtracting the maximum power consumption in a low-voltage power source becomes uneven as illustrated. Consequently, none of the aforementioned related technologies is applicable to a product designed for plural regions.

Stated differently, in the method of setting the maximum power, the maximum power supply has to be set at the lowest limit (1509) of the upper limit line (1506, 1508) of the usable power, so that the maximum power under a low voltage condition, which is least efficient for the warm-up time, is uniquely selected for all the voltage ranges.

SUMMARY OF THE INVENTION

It is an object of the present invention, relating to an improvement in the aforementioned induction heating fixing apparatus and an image forming apparatus provided with such induction heating fixing apparatus, to provide an apparatus enabling control of a maximum power regardless of a fluctuation in an AC line voltage and achieving an optimum distribution of the power in the entire image forming apparatus.

Another object of the present invention, made for solving the aforementioned drawbacks, is to provide an induction heating apparatus capable of providing an optimum maximum power for the suppliable power for each power supply voltage, a heat fixing apparatus utilizing such induction heating apparatus as a heat source, and an image forming apparatus provided with such heat fixing apparatus and having a short warm-up time.

A further object of the present invention is to provide an induction heating apparatus and a heat fixing apparatus including following configurations:

(1) An induction heating apparatus including inverter power supply means for controlling a switching interval for a commercial power supply according to a power control signal thereby supplying an excitation coil with a high frequency current of a predetermined power and executing induction heating of a heat generating member opposed to the excitation coil, and maximum power set/control means for arbitrarily setting a maximum output level of the inverter power supply means according to the input voltage of the commercial power supply;

(2) An induction heating apparatus according to (1), including induction heating means having means for detecting the temperature of the heat generating member, and temperature control means for generating a power control signal by comparing a temperature detected by the heat generating member temperature detecting means and a target temperature read from memory means, and executing a converging control of the induction heating means to the target temperature, based on such power control signal;

(3) An induction heating apparatus according to (1), in which the maximum power set/control means includes excitation current detecting means for detecting a current passing in the excitation coil, excitation current reference value generating means for generating an excitation current reference value, and power control means for comparing the detected excitation current and the excitation current reference value and executing a feedback correction on the power control signal, wherein the excitation current reference value and the feedback amount are so regulated as to select a maximum power for the power supply voltage;

(4) An induction heating apparatus according to (1), in which the maximum power set/control means includes an excitation current detection means for detecting a current passing in the excitation coil, reference frequency generation means for generating a predetermined frequency, and reference frequency power correction/control means for executing a maximum power setting operation of setting a correction value for the aforementioned power control signal according to a detected current value at a switching operation with the predetermined frequency by the reference frequency generation means and for executing the maximum power control thereafter by correcting the power control signal with such correction value;

(5) An induction heating apparatus according to (4), in which the maximum power setting operation is executed with the power control signal of a value which does not exceed an upper limit value of the rated suppliable maximum power at the upper limit of the operating voltage range;

(6) An induction heating apparatus according to (5), in which the maximum power setting operation is executed with the power control signal within a range from 5 to 20% of the variable range of the power control signal;

(7) An induction heating apparatus according to (4), including induction heating fixing means which rotates the heat generating member to execute a heat fixing operation on a sheet, wherein the maximum power setting operation is executed in a sheet non-passing state in the fixing operation;

(8) An induction heating apparatus according to (4), including induction heating fixing means which rotates the heat generating member to execute a heat fixing operation on a sheet, wherein the maximum power setting operation is executed while the rotation of the heat generating member is stopped;

(9) An induction heating apparatus according to (4), including induction heating fixing means which rotates the heat generating member to execute a heat fixing operation on a sheet, wherein the maximum power setting operation is executed by a correction with a temperature detected by a thermistor;

(10) An induction heating apparatus according to (4), in which the reference frequency power correction/control means includes operation control means for executing a calculation according to a power correction approximation equation determined in advance;

(11) An induction heating apparatus according to (4), in which the reference frequency power correction/control means includes table control means for referring to a maximum power setting table determined in advance;

(12) An induction heating apparatus according to (1), in which the maximum power set/control means includes power supply voltage detecting means for detecting the voltage of the commercial power supply, and power supply voltage detection-based power correction/control means for setting a correction value for the power control signal according to the detected voltage;

(13) An induction heating apparatus according to (1), in which the maximum power set/control means includes power consumption detecting means for detecting the voltage and current of the commercial power supply and determining a consumed power from data of such voltage and current, and power consumption detection-based power correction/control means for setting a correction value for the power control signal according to the detected power; and

(14) A heat fixing apparatus for conveying, under a pressure, a sheet bearing an unfixed toner image thereon, thereby heat fixing the unfixed toner image to the sheet, including an induction heating apparatus according to any of (1) to (13) as a heating apparatus for heating the sheet.

According to the present invention, in a configuration including inverter power supply means for controlling a switching interval for a commercial power supply according to a power control signal thereby supplying an excitation coil with a high frequency current of a predetermined power and executing induction heating of a heat generating member opposed to the excitation coil, and maximum power set/control means for arbitrarily setting a maximum output level of the inverter power supply means according to the input voltage of the commercial power supply, there is attained an effect of obtaining an optimum maximum power for the suppliable power at each power supply voltage.

According to the present invention, in a configuration including induction heating means having means for detecting the temperature of the heat generating member, and temperature control means for generating a power control signal by comparing and calculating a temperature detected by the heat generating member temperature detecting means and a target temperature read from memory means, and executing a converging control of the induction heating means to the target temperature, based on such power control signal, there is attained an effect of arbitrarily setting a time to reach the target temperature according to the input voltage of the commercial power supply.

According to the present invention, in a configuration in which the maximum power set/control means includes excitation current detecting means for detecting a current passing in the excitation coil, excitation current reference value generating means for generating an excitation current reference value, and power control means for comparing the detected excitation current and the excitation current reference value and executing a feedback correction on the power control signal, wherein the excitation current reference value and the feedback amount are so regulated as to select a maximum power for the power supply voltage, there is attained an effect that the detection of voltage or voltage and current is not required for determining the power, and the maximum power can be set with a relatively inexpensive current transformer only.

According to the present invention, in a configuration in which the maximum power set/control means includes an excitation current detection means for detecting a current passing in the excitation coil, reference frequency generation means for generating a predetermined frequency, and reference frequency power correction/control means for executing a maximum power setting operation of setting a correction value for the aforementioned power control signal according to a detected current value at a switching operation with the predetermined frequency by the reference frequency generation means and for executing the maximum power control thereafter by correcting the power control signal with such correction value, there is attained an effect of an optimum power control for each voltage.

According to the present invention, in a configuration in which the maximum power setting operation is executed with the power control signal of a value which does not exceed an upper limit value of the rated suppliable maximum power at the upper limit of the operating voltage range, there is attained an effect of reducing the power consumption by the maximum power setting operation and preventing a drawback that the upper limit of the rated suppliable maximum power is exceeded by an input of the upper limit value of the operation voltage range.

According to the present invention, there is attained an effect that the maximum power setting operation is executed with the power control signal within a range from 5 to 20% of the variable range of the power control signal.

According to the present invention, in a configuration including induction heating fixing means which rotates the heat generating member to execute a heat fixing operation on a sheet, wherein the maximum power setting operation is executed in a sheet non-passing state in the fixing operation, there is attained an effect of preventing an error in the maximum power setting operation resulting from a variation in the measured current.

According to the present invention, in a configuration including induction heating fixing means which rotates the heat generating member to execute a heat fixing operation on a sheet, wherein the maximum power setting operation is executed while the rotation of the heat generating member is stopped, there is obtained an effect of reducing the power consumption in the maximum power setting operation and extending the service life of the heat generating member.

According to the present invention, in a configuration including induction heating fixing means which rotates the heat generating member to execute a heat fixing operation on a sheet, there is attained an effect of executing the maximum power setting operation by a correction with a temperature detected by a thermistor.

According to the present invention, in a configuration in which the reference frequency power correction/control means is operation control means for executing a calculation according to a power correction approximation equation determined in advance, there is attained an effect of realizing an optimum power control according to the voltage.

According to the present invention, in a configuration in which the reference frequency power correction/control means includes table control means for referring to a maximum power setting table determined in advance, there is attained an effect of realizing an optimum power control according to the voltage.

According to the present invention, in a configuration in which the maximum power set/control means includes power supply voltage detecting means for detecting the voltage of the commercial power supply, and power supply voltage detection-based power correction/control means for setting a correction value for the power control signal according to the detected voltage, there is attained an effect of realizing an optimum power control according to the voltage.

According to the present invention, in a configuration in which the maximum power set/control means includes power consumption detecting means for detecting the voltage and current of the commercial power supply and determining a consumed power from data of such voltage and current, and power consumption detection-based power correction/control means for setting a correction value for the power control signal according to the detected power, there is attained an effect of realizing an optimum power control according to the voltage.

According to the present invention, in a heat fixing apparatus for conveying, under a pressure, a sheet bearing an unfixed toner image thereon, thereby heat fixing the unfixed toner image to the sheet, an induction heating apparatus of the present invention is provided as a heating apparatus for heating the sheet, thereby attaining an effect, utilizing the characteristics of the induction heating method with a rapid temperature increase to the heat processing temperature, of avoiding unnecessary current supply, eliminating waste in energy consumption, suppressing the temperature rise in the apparatus and achieving always stable heating fixing process.

A still further object of the present invention is to provide other image forming apparatus and induction heat fixing apparatus, including following configuration:

(1) An image forming apparatus including an induction heating fixing apparatus (113), in which a set value of a switching current supplied to the induction heating fixing apparatus is changed (602, 603) according to an operation of a unit which executes an image forming operation other than the heating operation of the induction heating fixation;

(2) An image forming apparatus utilizing an induction heating fixing apparatus (113) which functions by an electric power supply (100; commercial AC power supply; the apparatus including options being powered from a single receptacle) obtained from a single attachment plug (receptacle terminal 101), in which a set value of a switching current supplied to the induction heating fixing apparatus is changed (602, 603) according to an operation of a unit which executes an image forming operation other than the heating operation of the induction heating fixation;

(3) An induction heating fixing apparatus (113) including an induction heating coil (114), a fixing sleeve (10) constituting a heat generating member for executing fixation, a magnetic core (17) so constructed as to efficiently guide a magnetic field generated by the induction heating coil to the fixing sleeve, temperature detection means (115) maintained in contact with the fixing sleeve for detecting the temperature of the fixing sleeve, an induction heating inverter apparatus (602) for a power supply to the induction heating coil, means (122) for detecting a switching current in the induction heating coil or in the induction heating inverter apparatus, current control means for controlling the current according a detected value by the current detection means, and means (125) for setting the switching current flowing in the induction heating coil or the induction heating inverter apparatus (602);

(4) An induction heating fixing apparatus (113) including means (122) for detecting a switching current flowing in an induction heating coil (114) or in an induction heating inverter apparatus (602), first output determining means (D/A1) for determining an output amount which controls the output of the induction heating inverter apparatus, based on the detected value of the switching current, temperature detection means (115), second output determining means (D/A2) for determining an output amount which controls the output of the induction heating inverter apparatus, based on a signal from the temperature detection means, and means for preferentially outputting a signal which designates smaller one of the outputs of the first output determining means and the second output determining means;

(5) An induction heating fixing apparatus according to (4), including means for changing the set value of the first output determining means (D/A1) or the second output determining means (D/A2) by a control signal such as a control voltage from means for controlling the operation of the image forming apparatus;

(6) An induction heating fixing apparatus (113) according to (3) or (4), including means for changing the set value of the set value of the switching current or the set value of the first output determining means (D/A1) or the second output determining means (D/A2) based on detected temperature information of the temperature detection means (115) for detecting the temperature of the fixing sleeve (10);

(7) An induction heating fixing apparatus (113) according to (3) or (4), including means (603 or 121) for changing the set value of the switching current or the set value of the first output determining means (D/A1) or the second output determining means (D/A2) so as to execute a power supply to the induction heating coil (114) with a small power for a predetermined period;

(8) An induction heating fixing apparatus (113) according to (3) or (4), including means (115) for detecting the temperature of the fixing sleeve (10) and means (603 or 121) for executing a power supply to the induction heating coil (114) with a small power for a predetermined period and then changing the suppliable maximum power to the induction heating coil, based on detected temperature information of the temperature detection means for the fixing sleeve.

The present invention is, in a system for controlling the electric power by a current control without a voltage detection, in an induction heating fixing apparatus, particularly in an induction heating inverter apparatus (voltage oscillation inverter apparatus), to change a current control target value according to the operation of a unit other than for fixing, and, in the present invention, there is provided means which detects the current by current detection means for detecting a current flowing in the induction heating coil and executes a current control so as to maintain a peak current value or an average current at a constant level, thereby enabling a control of the maximum power without being influenced by a fluctuation in the AC line voltage, and, the target values of the current detection and the control circuit are changed according to the operation of an image forming apparatus thereby achieving optimum power distribution in the entire image forming apparatus.

According to the present invention, a control to maintain the average current or the peak current of the induction heating fixing apparatus at a constant level enables to achieve a power control of little voltage dependence without employing voltage detection means, and the control target is made variable thereby achieving a fixing power control matching the operation of the image forming apparatus by a simpler configuration. Further, by varying the control target value according to the detected temperature by the temperature detection means, there is enabled a power control of the induction heating fixing apparatus with little temperature dependence.

Other objects and aspects of the invention will become apparent from the following description of embodiments with reference to the accompanying drawings.

DESCRIPTION OF THE PREFERRED EMBODIMENTS

In the following, the present invention will be further clarified by preferred embodiments thereof, with reference to the accompanying drawings.

(First Embodiment)

Figure 1:
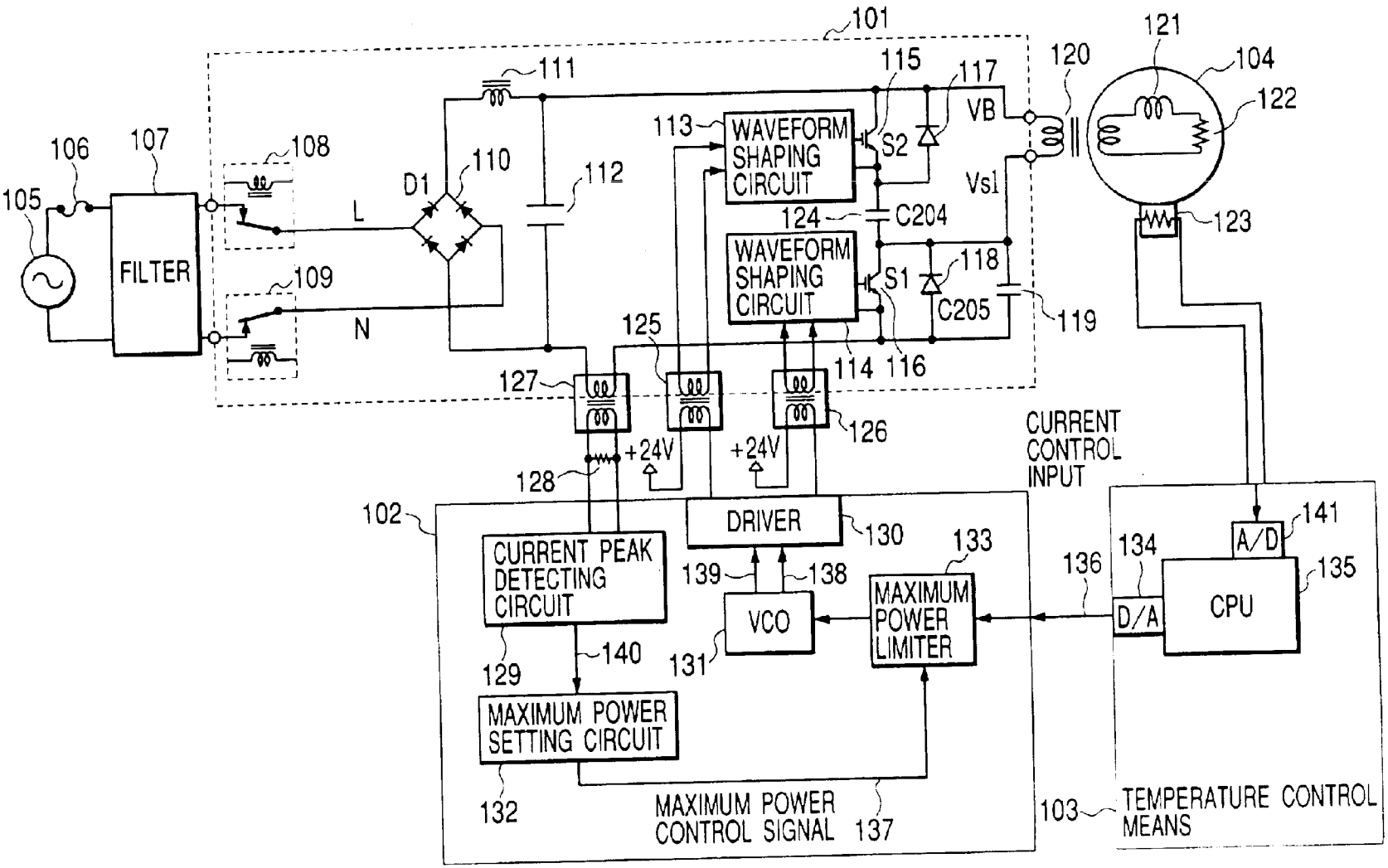
FIG. 1 is a block diagram schematically showing the configuration of a first embodiment of the present invention.
Figure 2:
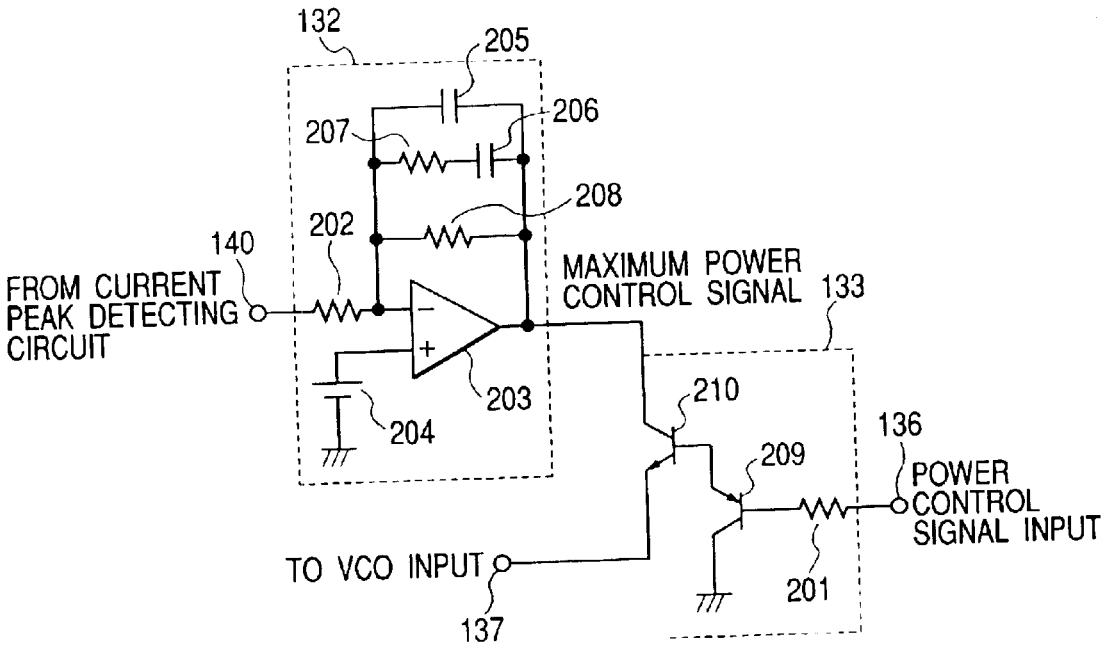
FIG. 2 is a circuit diagram showing a maximum power setting circuit in the first embodiment of the present invention.
Figure 3:
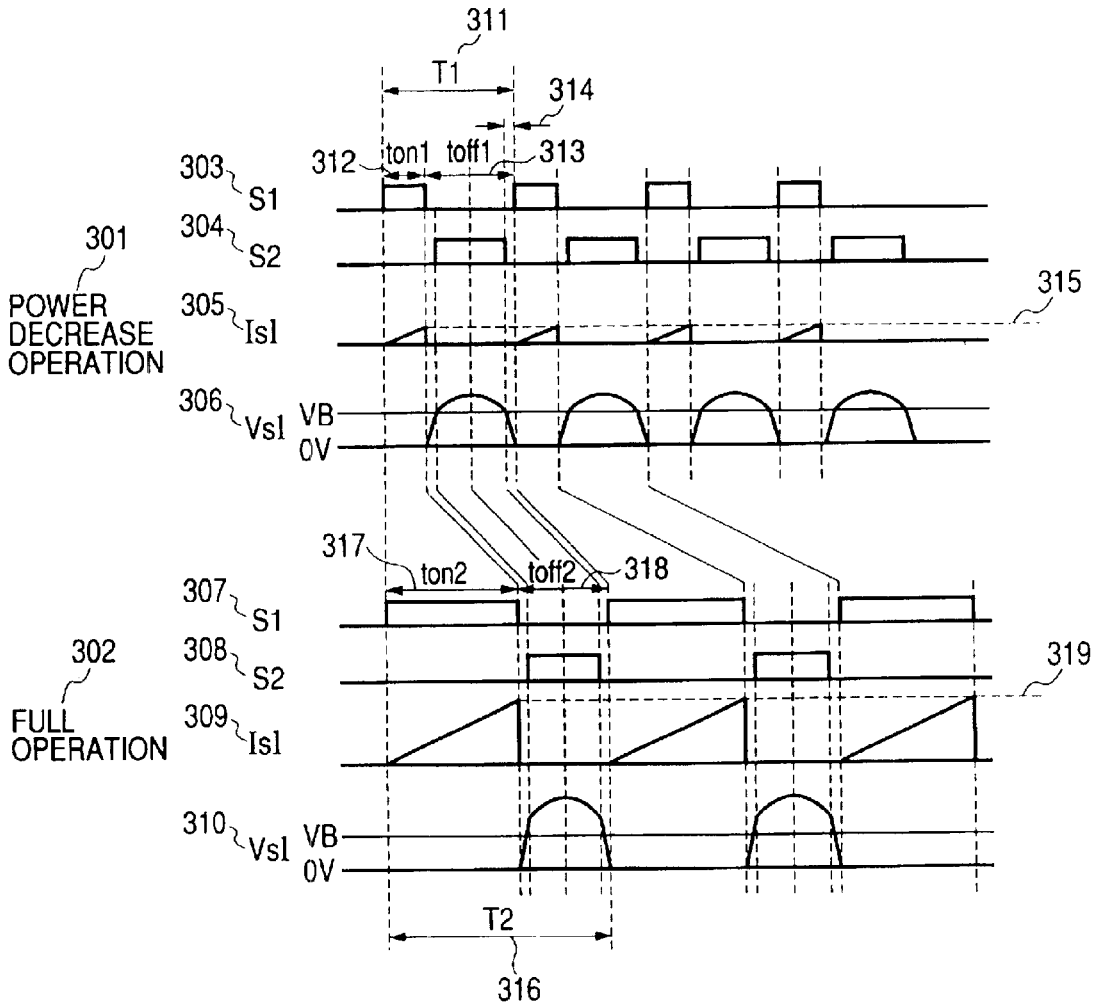
FIG. 3 is a wave form chart explaining a power control operation in the first embodiment of the present invention.
Figure 4:
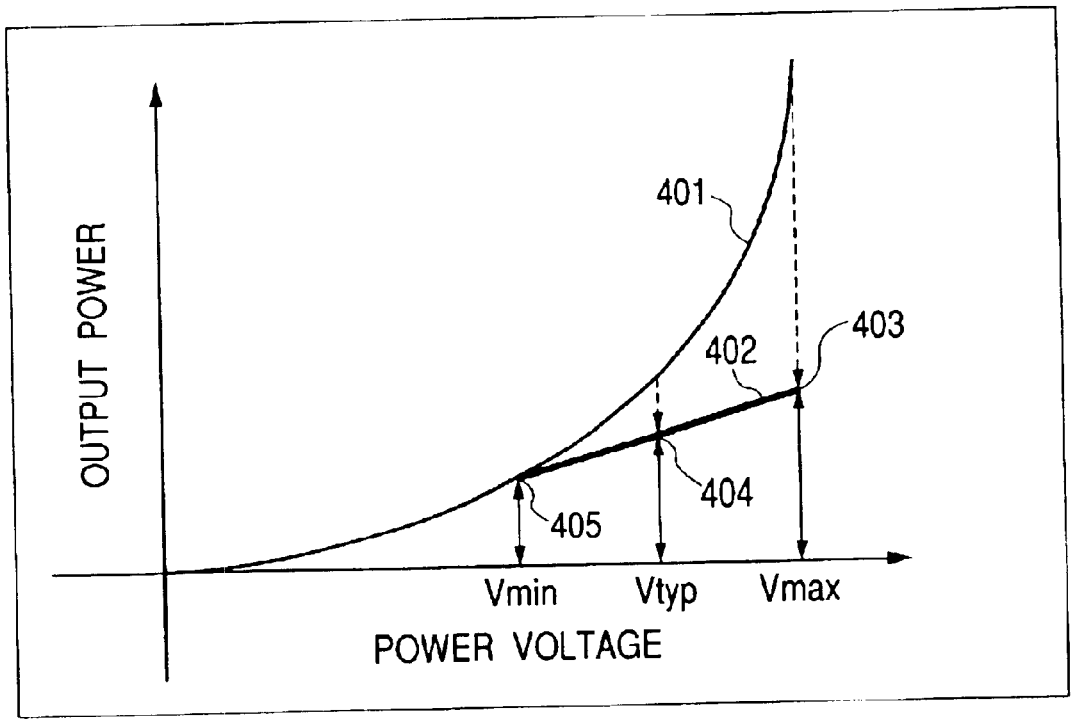
FIG. 4 is a voltage-current characteristic chart for explaining a maximum power limiting characteristics in the first embodiment of the present invention.
Figure 5:
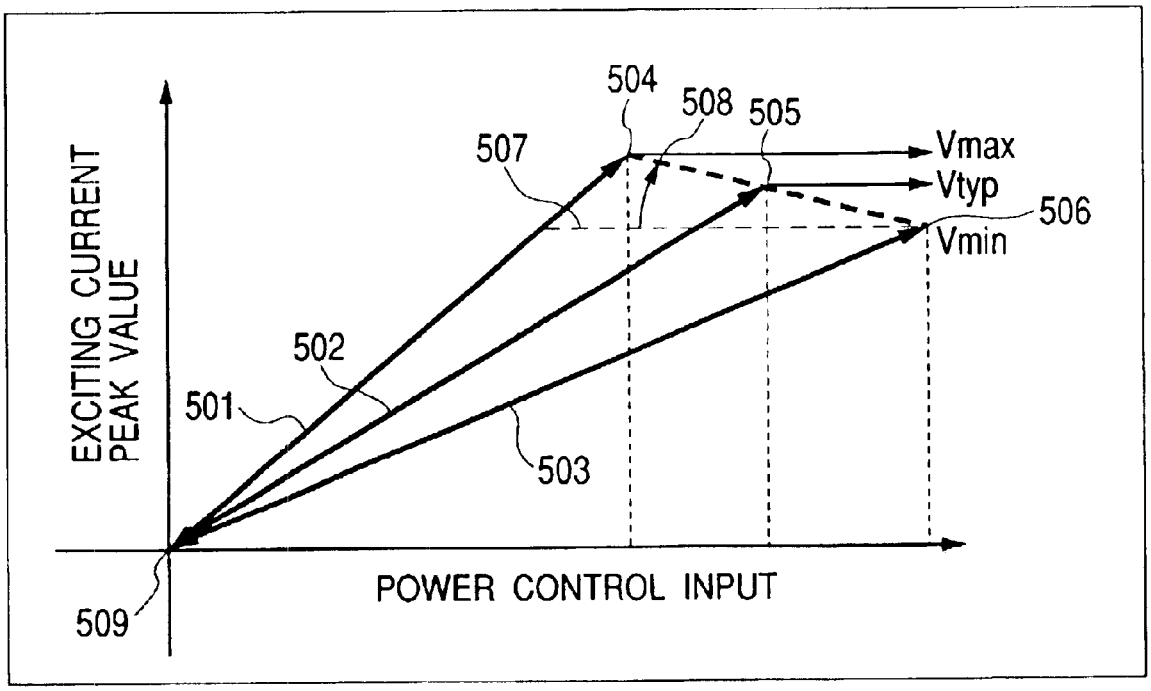
FIG. 5 is a power control input-excitation peak current characteristic chart for explaining the maximum power limiting characteristics in the first embodiment of the present invention.
Figure 6:
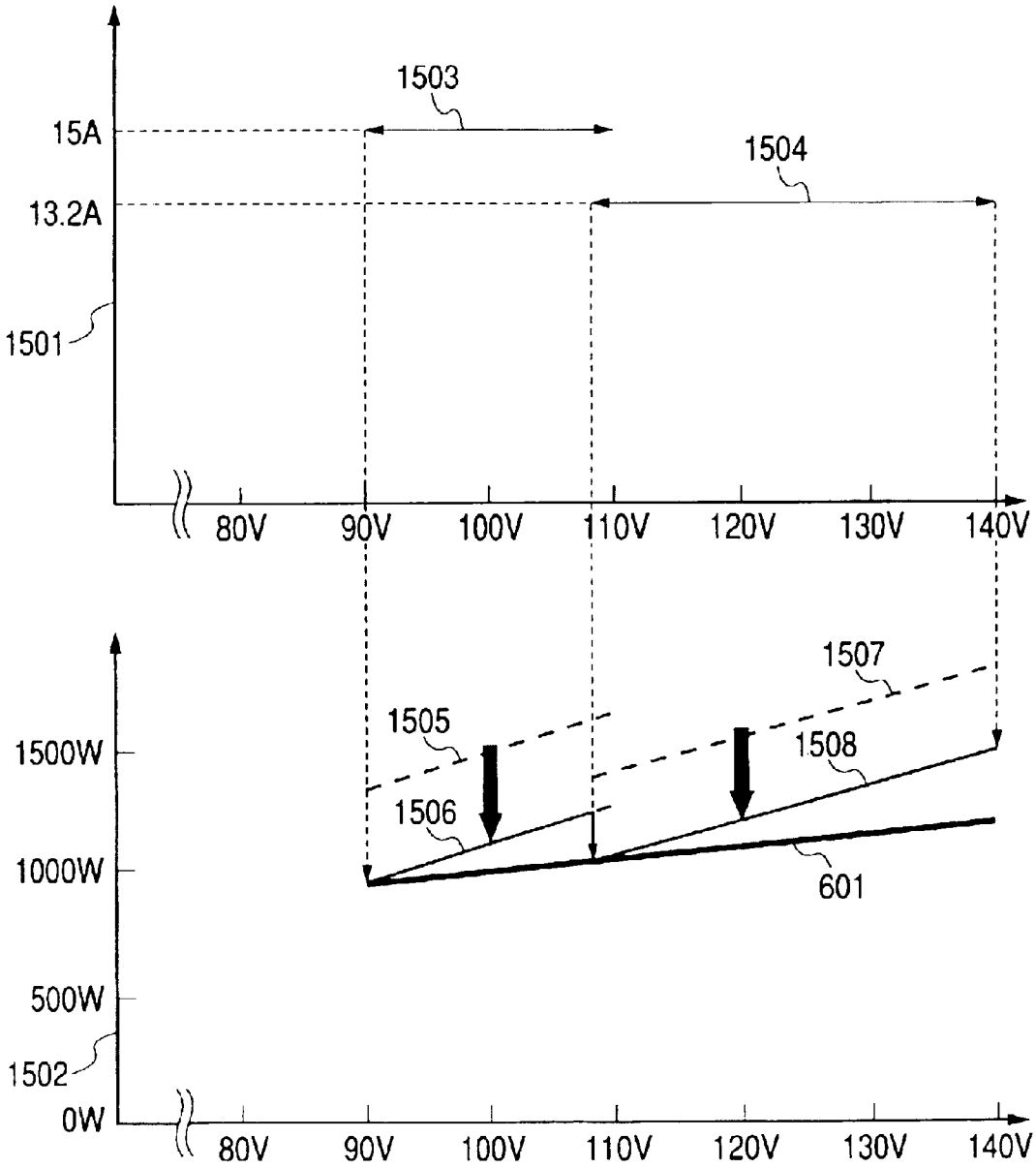
FIG. 6 is a power supply voltage-power characteristic chart showing the relationship between a usable power supply current at 15 A rating and maximum power limiting characteristics in the first embodiment of the present invention.

FIG. 1 is a block diagram schematically showing the configuration of a first embodiment of the present invention, FIG. 2 is a circuit diagram showing an example of a maximum power setting circuit 132 and a maximum power limiter 133, FIG. 3 is a wave form chart explaining a power control operation in the first embodiment, FIG. 4 is a voltage-current characteristic chart for explaining a maximum power limiting characteristics in the first embodiment, FIG. 5 is a power control input-excitation peak current characteristic chart for explaining the maximum power limiting characteristics in the first embodiment, and FIG. 6 is a power supply voltage-power characteristic chart showing the relationship between a suppliable upper limit current in a 15 A rated cord and an upper limit power in the first embodiment.

(Schematic Configuration)

In the following, the configuration of the first embodiment will be schematically explained with reference to FIG. 1.

A primary circuit unit 101 constitutes an inverter power source means for turning on/off switches 115, 116 based on a control pulse from an oscillation control unit 102, thereby passing a commercial power supply 105 to an excitation coil 120. The configuration of the primary circuit unit 101 will be explained in more detail.

The primary circuit unit 101 is connected to a commercial power supply 105 through a safety fuse 106 and a line filter 107, and the AC power supply entered through safety relays 108 for preventing an excess temperature increase is full-wave rectified by a bridge diode 110. There are also provided a choke coil 111 for preventing noise leakage and a smoothing capacitor 112 for impedance reduction, and these components constitute a DC power source circuit for inverter. Also there is provided an inverter switch circuit for supplying two-phase control pulses, outputted from an oscillation control unit 102, to gates of a main switch 116 and a sub switch 115 formed by IGBTs, through pulse transformers 126, 125 and wave shaping circuit 114, 113. IGBT is an abbreviation for an induced gate barrier transistor, which is also called a conductivity modulation field effect transistor. It is generally formed as a p-channel type, and constituted on a single chip by a circuit of extracting the base of a collector-grounded PNP transistor by the drain of a P-channel MOS transistor, thereby achieving a high speed of a MOS device and a driving ability and a voltage resistance of a bipolar transistor.

Body diodes 117, 118 for the main switch 116 and the sub switch 115 formed by IGBTs are integrally incorporated in the IGBTs as illustrated in FIG. 1. A main resonance capacitor 119 is connected parallel to the main switch 116 and executes a flyback resonance with an excitation coil 120 in an off-state of the main switch 116. A sub resonance capacitor 124 is connected, through the sub switch 155, parallel to the excitation coil 120 and executes a flyback resonance with the excitation coil 120 in an on-state of the sub switch 115.

In the following, a power control operation in the above-described inverter configuration will be explained with reference also to a wave form chart in FIG. 3, in which 301 shows operation wave forms in a power decrease operation while 302 shows operation wave forms in a full operation.

The two-phase control pulses from the oscillation control unit 102 are generated by a 2-phase oscillator VCO (131) of which on-width is regulated according to an input voltage. The 2-phase signals generated by the 2-phase oscillator VCO (131) drive pulse transformers 125, 126 through a driver 130, and a main excitation signal 138 corresponds to gate signals 303, 307 (FIG. 3) for the main switch 116, while a sub excitation signal 139 corresponds to gate signals 304, 308 (FIG. 3) for the sub switch 115. The gate signal for the sub switch 115 is generated in alternate manner and turned on during an turn-off period of the main switch 116. Also in order to avoid simultaneous turn-on with the main switch 116, there is added a dead time 314 (FIG. 3).

In FIG. 3, 305 and 309 indicate a collector current Is1 of the main switch 116 in the aforementioned gate signal pattern, and 306 and 310 indicate a collector-emitter voltage Vs1 of the main switch 116. When the main switch 116 is turned on, the power supply voltage VB is applied to the excitation coil 120, whereby a current is charged with a current rate determined by dividing the power supply voltage VB with an equivalent inductance 121. Consequently, current peak values 315, 319 vary in proportion to on-times tON1 (312) tON2 (317) of the main switch.

When the main switch 116 is turned off, by a current charged in the excitation coil 120, the collector voltage Vs1 at first charges the main resonance capacitor 119 to generate a flyback voltage in the collector-emitter voltage Vs1, and, upon reaching a voltage where the body diode 117 of the sub switch 115 is turned on, further charges the sub resonance capacitor 124 whereby a voltage resonance takes place around the power supply voltage VB with a time constant determined by a sum of the capacity of the sub resonance capacitor 124 and the capacity of the main resonance capacitor 119 and by the equivalent inductance 21 of the excitation coil 120.

When the sub switch 115 is turned off during a descent of the collector-emitter voltage Vs1 in the voltage resonance, the current energy which is inversion charged in the excitation coil 120 is switched, from the inversion charging of the main and sub resonance capacitors 119, 124, to the inversion charging only to the sub resonance capacitor 124 thereby causing a rapid voltage drop.

By selecting the capacity of the sub resonance capacitor 124 sufficiently larger than the capacity of the main resonance capacitor 119, it is made possible to achieve a secure drop to 0 V even at a small on-time of the main switch with a small amplitude, also to achieve a soft switching at the turn-on of the main switch and to bring the flyback resonance wave form close to a rectangular form, and to suppress the flyback peak voltage while maintaining short off-times tOFF1, tOFF2 (313, 318) in comparison with the switching cycle T1 (311) thereby obtaining a wide power regulation range and a large maximum power with the IGBT of a low voltage resistance.

Heat is generated by a Joule's heat loss which is generated by an eddy current induced in a rotary heat generating member 104 by a magnetic field proportional to the voltage applied to the excitation coil 120 and flowing in an equivalent resistance 122 of the heat generating member. An engine control unit 103 is formed by a CPU 135 connected to an A/D converter 141 and a D/A converter 134. The unit fetches, through the A/D converter 141, a detection voltage of a thermistor 123 for detecting the temperature of the rotary heat generating member 104 which is heated by the excitation coil 120, 141, then compares it with a predetermined target temperature and outputs a power control signal through the D/A converter 134 to the oscillation control unit 102 to regulate the on-time of the main switch 116, thereby regulating the excitation current to control the heat generating power and to achieve temperature control.

In the above-described configuration, however, since the excitation coil 120 including the equivalent resistance 122 of the heat generating member has macroscopically load characteristics of a resistor, there is encountered that the input power varies in proportion to a square of the voltage as shown by 401 in FIG. 4, even though the voltage such as of the commercial power supply fluctuates in different regions and the voltage rating has to be secured wide.

In the present invention, therefore, a maximum power setting control circuit 132 is employed to achieve controllability as indicated by 403 in FIG. 4.

A maximum power setting operation is executed with a power control signal value within a range of 5 to 20% of the variable range of the power control signal. The power control signal is given a range of 5 to 20% because it varies by the characteristics of the apparatus and is to be determined experimentally. In the present embodiment, there is used 18H in hexadecimal representation of 8-bit data (18H/FFH=9.4%). The characteristics of the apparatus are represented by a percentage of the power control value at which the maximum permissible power of the fixing device, including fluctuation thereof, is not exceeded. The percentage is determined, with reference to the aforementioned characteristics of the apparatus, by a power control value providing a minimum power within a range capable of assuring the setting accuracy of the power setting operation.

A current transformer 127 is connected at the primary side thereof serially to a ground line of a DC power source of the inverter, and executes a conversion into a voltage wave form by a current transformer load resistor 128 connected at the secondary side, for supply to a current peak detection circuit 129. The current peak detection circuit 129 holds, by predetermined time constant, a peak value of the current charged in the excitation coil 120, and sends it to a maximum power setting circuit 132.

The maximum power setting circuit 132 outputs a maximum power control signal 137 to a maximum power limiter 133, which outputs a power control signal 136 from the engine control unit 103 to the VCO (131) with a limitation not exceeding the level of the maximum power control signal 137, thereby limiting the on-time of the main switch 116.

FIG. 2 is a circuit diagram of the maximum power setting circuit 132 and the maximum power limiter 133, and the maximum power setting function will be explained with reference to FIG. 2.

An input resistor 202, receiving a peak current detection signal 140 from a current peak detection circuit 129, is connected to a minus input of an operational amplifier 203. A feedback resistor 208 is connected between an output of the operational amplifier 203 to a minus input thereof, and determines a gain of an inversion amplifier circuit by a ratio with the input resistor 202. A feedback capacitor 205 constitutes a low-pass filter, while a capacitor 206 and a resistor 207 constitute a phase compensation circuit, which limits the function of the inversion amplifier circuit so as not to respond to a voltage variation of the frequency which exceeds the power supply frequency. A reference voltage 204 is compared with the peak current detection signal 140, and a resulting error signal is amplified by the inversion amplifier circuit and is outputted as a maximum power control signal to the maximum power limiter circuit 133.

In the following there will be given an explanation on the maximum power limiter circuit 133.

An input resistor 201, receiving the power control signal 136, is connected the base of an input transistor 209. The power control signal 136 is elevated by the base-emitter voltage VBe of the input transistor 209, and is entered into the base of a next output transistor 210. As the output of the output transistor 210 is obtained from the emitter thereof, the power control signal 136, which is elevated by the base-emitter voltage VBe and entered into the base is again reduced by the base-emitter voltage VBe of the output transistor 210 thereby reproducing the original voltage control signal.

Since the collector of the output transistor 210 is biased by the input of the maximum power control signal, there cannot be outputted a higher voltage. By these limiter operations, the voltage control signal is limited to the maximum power control signal or lower.

As explained in the foregoing, the peak value of the excitation current flowing in the current transformer 127 and the predetermined peak value obtained from the reference voltage are used, and the limitation is made to a value obtained by multiplying the difference between the observed peak current and the reference peak current with the predetermined gain, whereby the power control input is reduced and the increase of the excitation current resulting from an increase of the power supply voltage is controlled to intended characteristics.

More specifically, as shown in FIGS. 4 and 5, the reference peak current is set by a desired output power (507) at a lower limit value (minimum value) (405) of the operation voltage, then a power slope (402) against voltage is determined from an upper limit (404) of the suppliable power present below the upper limit voltage, and a gain (508) of the inversion amplifier circuit in the maximum power setting circuit 132 is determined from the desired output power at the upper limit voltage, and the peak current value and the necessary power control voltage (504) in such state.

These operations can be represented by following equations:

In case of: Reference peak current=peak current at lower limit voltage, lower limit voltage power control input=maximum value of power control input;

gain (feedback resistance 208/input resistance 202)=(lower limit voltage power control input−upper voltage power control input)/(upper limit voltage peak current−reference peak current).

In the above-explained configuration, the excitation current peak value responds to the power control input so as to limit the on-time of the main switch to any power control input, for each power supply voltage such as represented by 501, 502 or 503.

FIG. 6 is a power supply voltage-power characteristic chart showing the relationship between a suppliable upper limit current in a 15 A rating cord and an upper limit power in the first embodiment of the present invention, and such relationship will be explained with reference to the control characteristics shown in FIGS. 4 and 5. As shown in a chart 1501 in FIG. 6, the current usable for a rating is different depending on the safety regulations of each region. There are shown an operation voltage range and an upper limit suppliable current in Japan (1503) and in UL standard (1504). By rewriting these into a power, there are obtained, as shown in a chart 1502, lines 1505 (Japan) and 1507 (UL) indicating an upper limit power for the power supply voltage. By subtracting the maximum power consumption in a low-voltage power source, the power available for fixing is represented by lines 1506 (Japan) and 1508 (UL) (power factor in the present embodiment being assumed as 100%). UL is an abbreviation for Underwriters Laboratory, which is a private association established by the U.S. insurance companies for ensuring the safety of electrical products, or a safety standard determined by such association.

Therefore, the maximum power setting adaptable to both regions is obtained by setting an operation lower limit voltage (1506) at 90 V, setting a reference peak current based on the peak current at the maximum power control signal, further setting the suppliable upper limit power (1505), present below the upper limit voltage, at 108V, and determining the gain (1508) of the inversion amplifier circuit of the maximum power setting circuit 132 according to the aforementioned equation, thereby executing an operation along a maximum power setting line 601.

In a heating apparatus in which the rotary heat generating member 104 is directly heated and the heat loss is reduced as in the induction heating, such close positioning of the maximum power setting line 601 to the suppliable upper limit power 1506, 1508 provides an effect of significantly improving the first print time, since the start-up speed is significantly influenced by the thermal energy per unit time.

(Second Embodiment)

Figure 7:
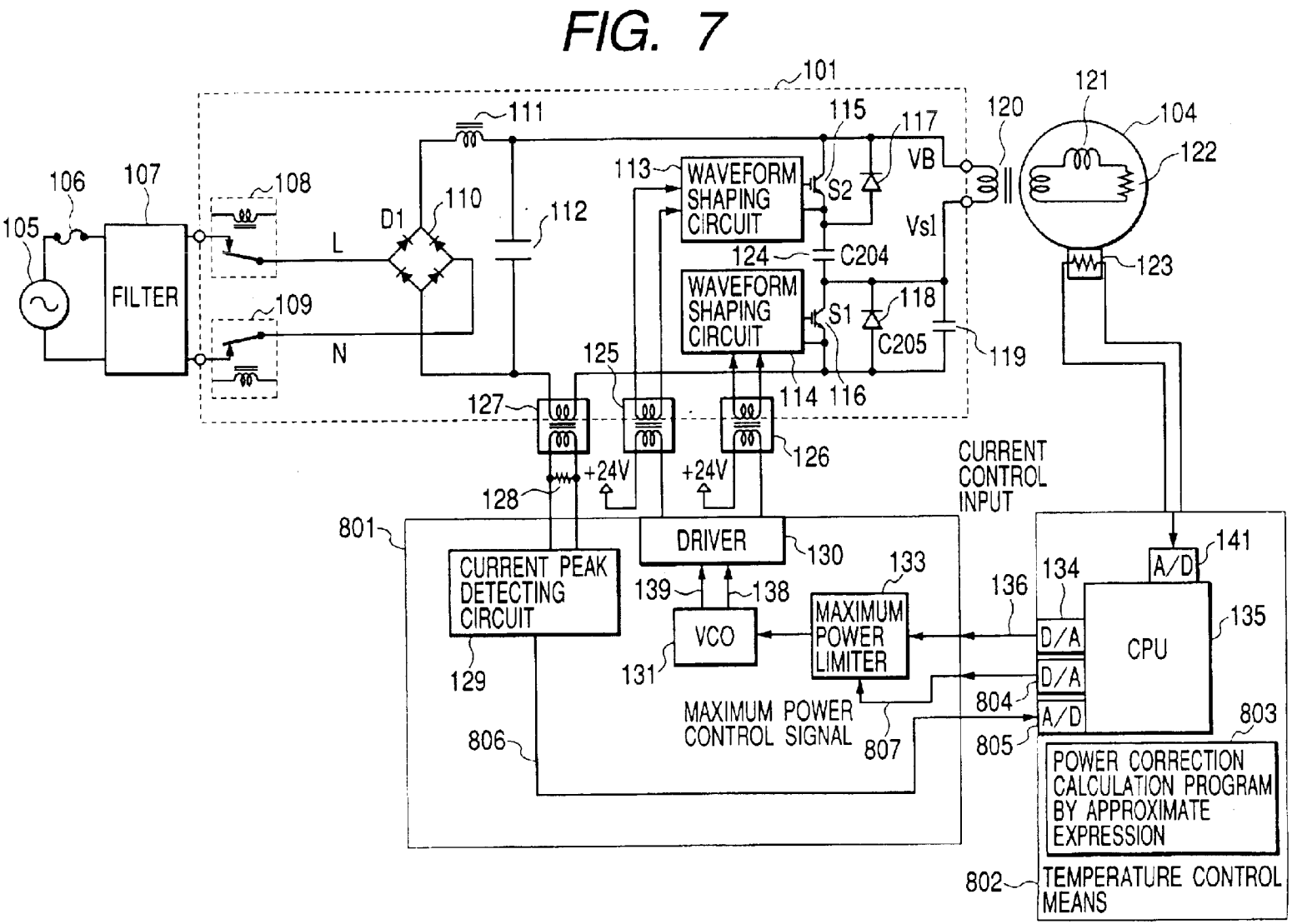
FIG. 7 is a block diagram schematically showing a second embodiment of the present invention.
Figure 8:
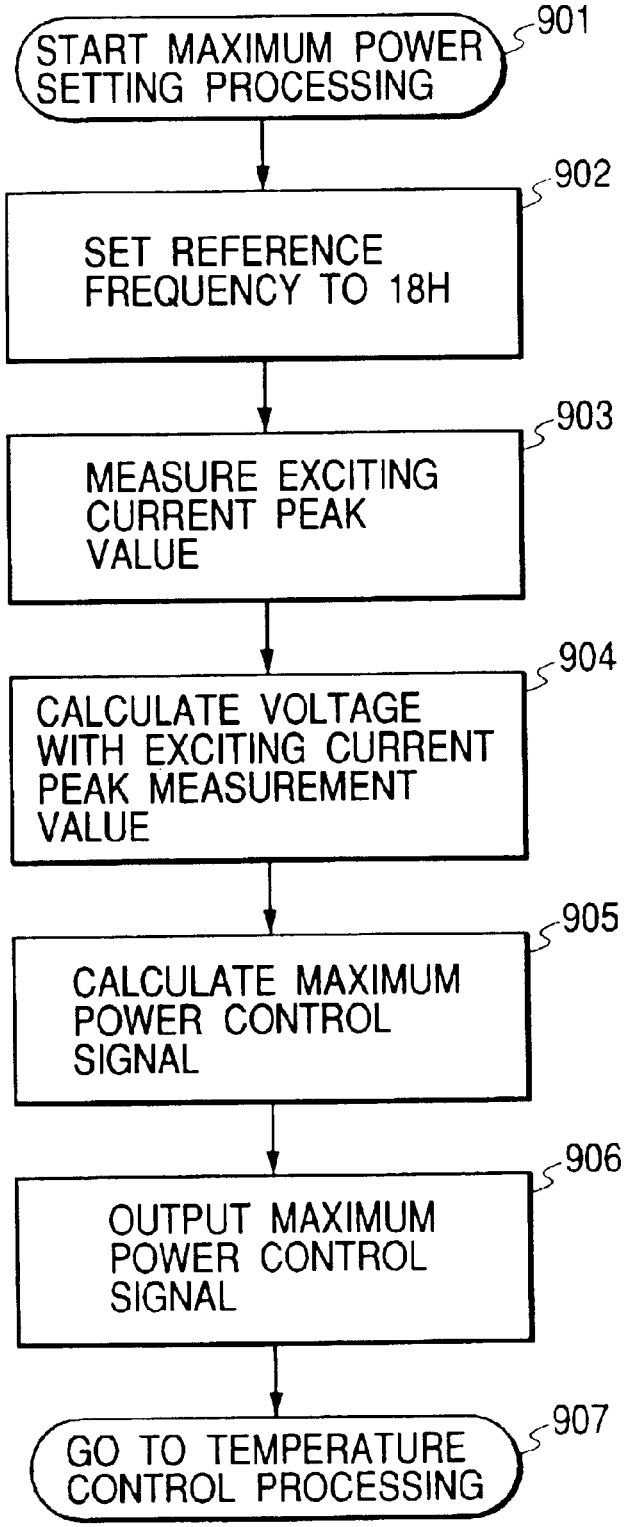
FIG. 8 is a flow chart showing the configuration of a software control of the second embodiment of the present invention.
Figure 9:
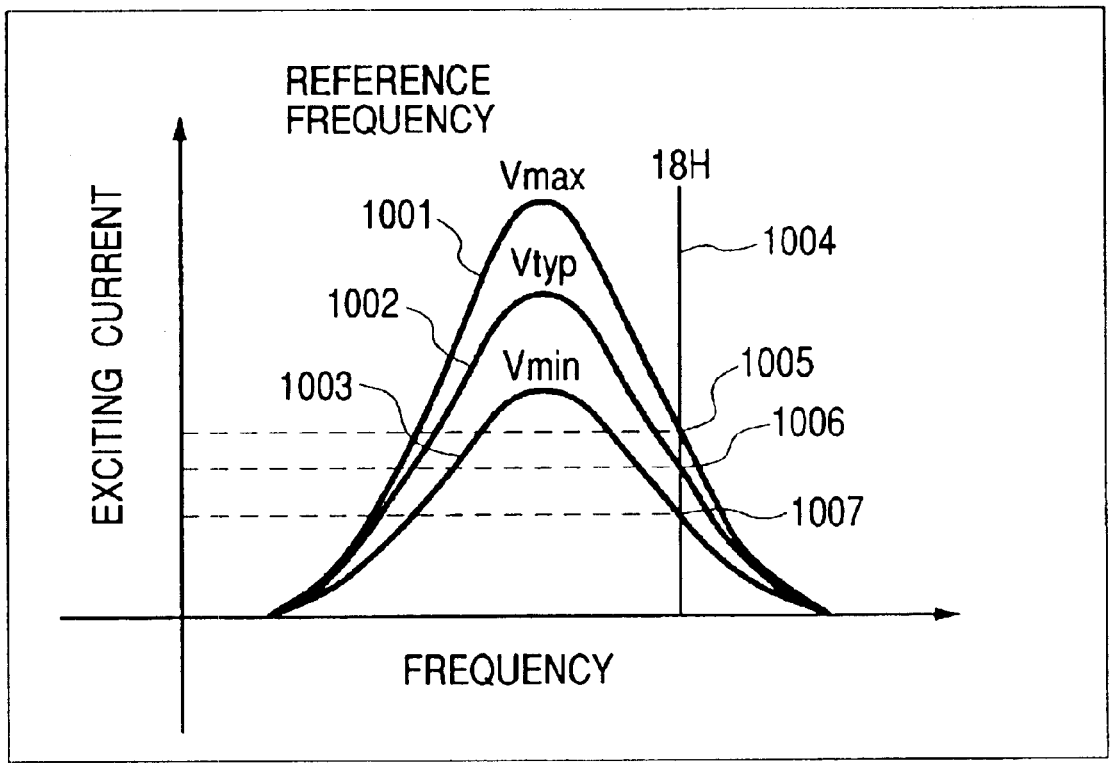
FIG. 9 is an impedance characteristic chart of an excitation coil, for explaining the principle of a maximum power control in the second embodiment of the present invention.

FIG. 7 is a view schematically showing the configuration of a second embodiment of the present invention, wherein components equivalent in construction and in function to those in the foregoing first embodiment will be represented by same numbers and will not be explained further. FIG. 8 is a flow chart showing the configuration of a software control of the second embodiment, and FIG. 9 is a chart showing impedance characteristics of the excitation coil 120 for explaining the principle of maximum power control featuring the second embodiment of the present invention.

In contrast to the first embodiment in which the maximum power setting means is set by the reference current value and a fixed constant setting means formed by the feedback gain, the second embodiment is most featured by the use of a dynamic setting means for setting the power control signal according to the excitation current at a predetermined frequency condition.

In the following there will be given an explanation with reference to FIG. 7. An oscillation control unit 801 includes a current peak detection circuit 129, a driver 130, a VCO 131 and a maximum power limiter 133, and, as in the first embodiment, the current peak detection circuit 129 enters a peak current detection signal, obtained from the excitation current wave form, into the A/D converter 805 of the engine control unit 802.

The engine control unit 802 is provided with the CPU 135 having a power correction approximation program in a program ROM area, D/A converters 134, 804 and A/D converters 141, 805, and the D/A converter 804 of an 8-bit resolving power enters a maximum power control signal 807 into a maximum power limiter 133. The power correction approximation program 803 utilizes the maximum power setting equations employed in the first embodiment.

Now the maximum power setting process will be explained with reference to FIG. 8.

The CPU 135, prior to the temperature control, initiates the maximum power setting process (901), and sets the power control input at 18H (902), which is a hexadecimal representation of the power control range in 8-bit data.

Then a power control input weaker than normal is switched with a frequency corresponding to an ON-time of 18H (1004 in FIG. 9), and there is measured an excitation peak current (903) determined by the power supply voltage of the excitation coil 120 and the impedance characteristics (1001, 1002, 1003 in FIG. 9) thereof.

The CPU 135 calculates the power supply voltage from the peak detection current by multiplying a power supply voltage/peak current coefficient (904), then further multiplies a maximum power control signal/power supply voltage coefficient determined from the maximum power setting equation employed in the first embodiment to obtain a set value of the maximum power control signal (905), and outputs a maximum power control signal 807 from the D/A converter 804 to the maximum power limiter 133 (906). Thereafter the temperature control is executed in the same manner as in the first embodiment to set the maximum power (907).

The above-described maximum power setting operation is executed in a sheet non-passing state in the fixing operation. The above-described control provides the maximum power setting characteristics equivalent to those in the first embodiment, shown in FIG. 6.

The power correction approximation program 803 in the present embodiment employs the maximum power setting equation employed in the foregoing first embodiment for the clarity of the explanation, but there may also be employed another approximation equation determined experimentally.

(Third Embodiment)

Figure 11:
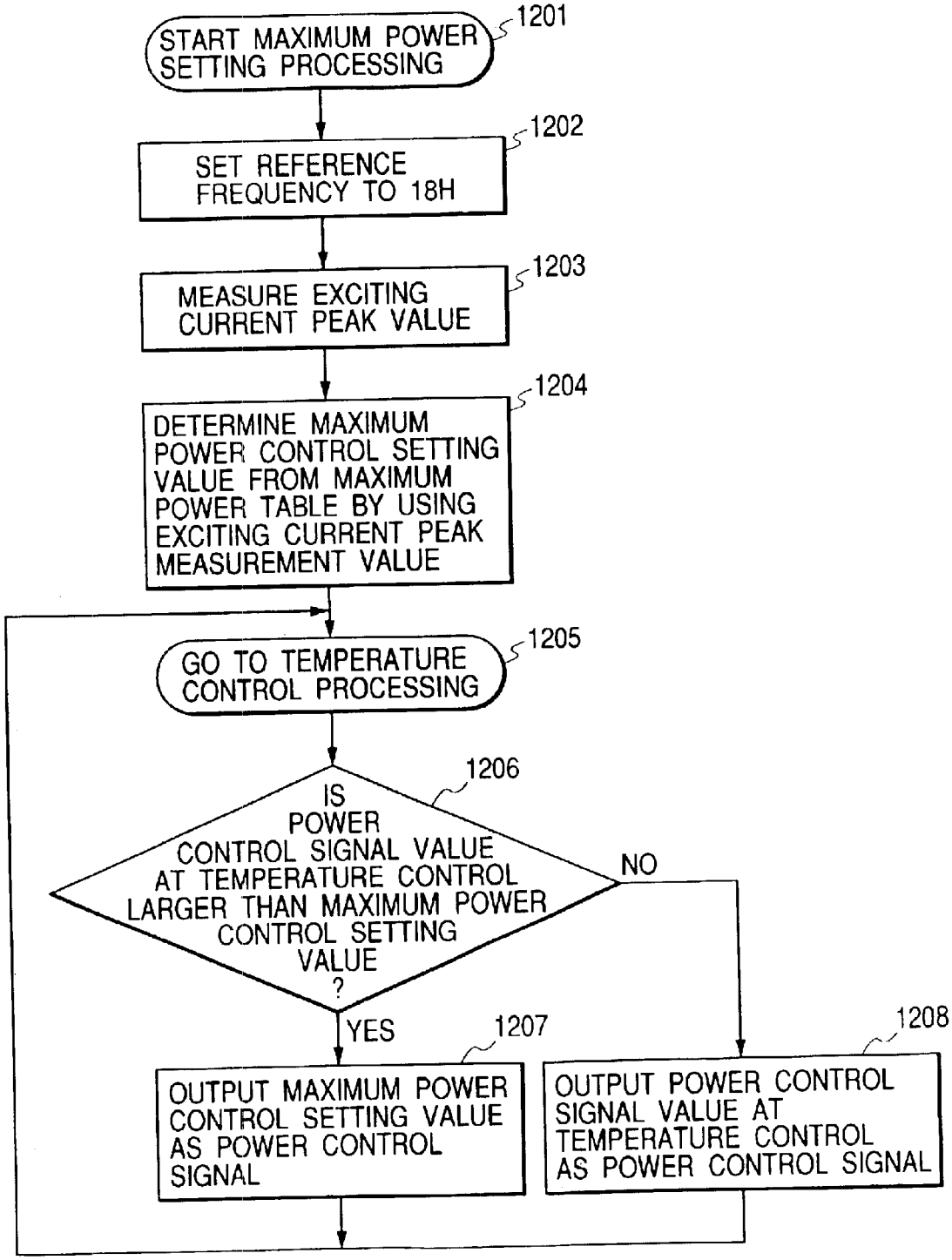
FIG. 11 is a flow chart showing the configuration of a software control of the third embodiment of the present invention.
Figure 12:
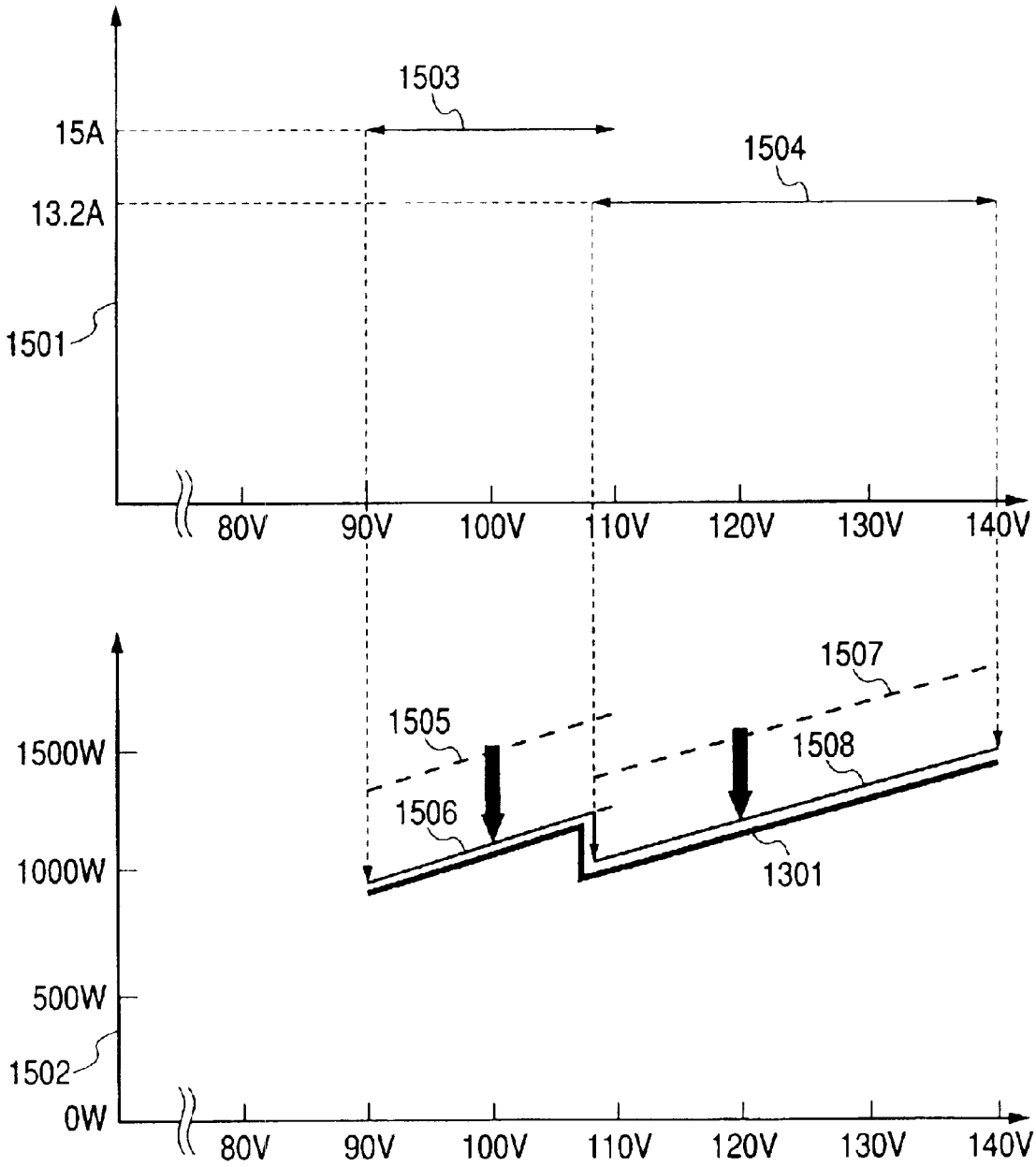
FIG. 12 is a power supply voltage-power characteristic chart showing the relationship between a usable power supply current at 15 A rating and maximum power limiting characteristics in the third embodiment of the present invention.

FIG. 11 is a view schematically showing the configuration of a third embodiment of the present invention, wherein components equivalent in construction and in function to those in the foregoing first embodiment will be represented by same numbers and will not be explained further. FIG. 12 is a flow chart showing the configuration of a software control of the third embodiment, and FIG. 9 is a power source voltage-power characteristic chart showing the relationship between the usable power at suppliable upper limit current and the maximum power limiting characteristics in a 15 A rating cord.

In contrast to the second embodiment in which the maximum power setting means is constituted by hardware control means for entering the maximum power control signal 807 generated in the CPU 135 into the maximum power limiter 133 thereby limiting the power control signal, the third embodiment is featured in that the maximum power setting means is constituted by pure software control means which determines the maximum power from the detected value of the excitation current by the reference frequency by referring to a maximum power set value table, and causes the maximum power to reflect on the power control output in the temperature control by direct comparison.

Figure 10:
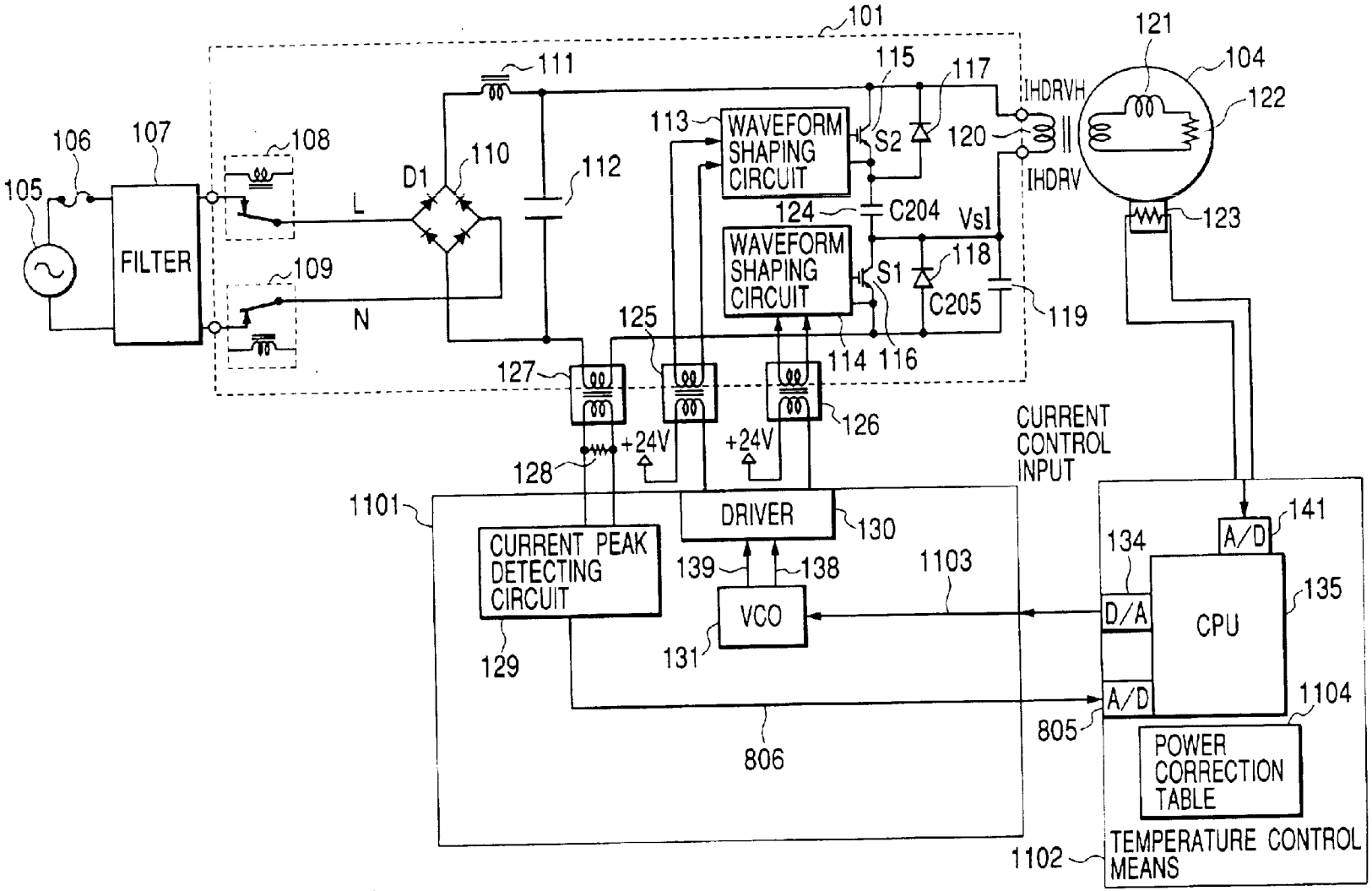
FIG. 10 is a block diagram schematically showing a third embodiment of the present invention.

In the following there will be explained the hardware configuration with reference to FIG. 10 and the software configuration with reference to FIG. 11.

An oscillation control unit 1101 is provided with a current peak detection circuit 129, a driver 130 and a VCO 131, and a power control signal 1103 is supplied from an engine control unit 1102 directly to the VCO 131.

An engine control unit 1102 is provided with an A/D converter 141, a D/A converter 134 and a power correction table 1104, and the CPU 135, prior to the temperature control, initiates a maximum power setting process thereby setting a power control input at 18H (1201, 1202).

Upon setting of the power control signal at 18H, the excitation current peak value is measured under switching with the reference frequency (1203). The read excitation current peak value is used for referring to the maximum power set value table 1104 to set the maximum power (1204).

Then the sequence proceeds to a temperature control process (1205). A power control value of the temperature control, based on a comparison of the temperature of the thermistor and a target temperature, is compared with the maximum power set value (1206), and, in case of NO where the power control value of the temperature control is less than the maximum power set value, such power control value of the temperature control is outputted as a power control value (1208), but, in case of YES where the power control value is at least equal to the maximum power set value, such maximum power set value is outputted as the power control signal (1207), whereupon the sequence returns to (1205), to repeat the process of the steps (1206) to (1208).

The third embodiment of the present invention is most featured in that the maximum power set value table 1104 is used for the correction of the maximum power by the switching of the reference frequency, and such use allows an discontinuous setting of the maximum power for each power supply voltage and enables to increase the fixing power almost up to the usable power as indicated by a maximum power setting line 1301 in FIG. 12. Also there is provided an advantage that the configuration can be made inexpensive as the maximum power limiter is realized by a software.

In the foregoing embodiments, the heating process is usually executed by rotating the heat generating member of the induction heating, but, in the setting of the maximum power under the drive with the reference frequency, the control means may be so constructed as to execute such setting while the rotation of the rotary heat generating member 104 is stopped during a sheet non-passing state. Such control allows to prevent a waste of the electric power resulting from the idle rotation of the rotary heat generating member 104 and to extend the service life thereof.

Also in the foregoing third embodiment, it is also possible to detect the temperature of the rotary heat generating member 104 by the thermistor 123, adding a temperature parameter to the power correction table 1104 and switching the power correction table 1104 according to the detected temperature, thereby correcting an influence on the load impedance of the excitation coil resulting from the temperature of the heat generating member and thus suppressing the temperature-dependent variation of the maximum power set value.

(Fourth Embodiment)

Figure 15:
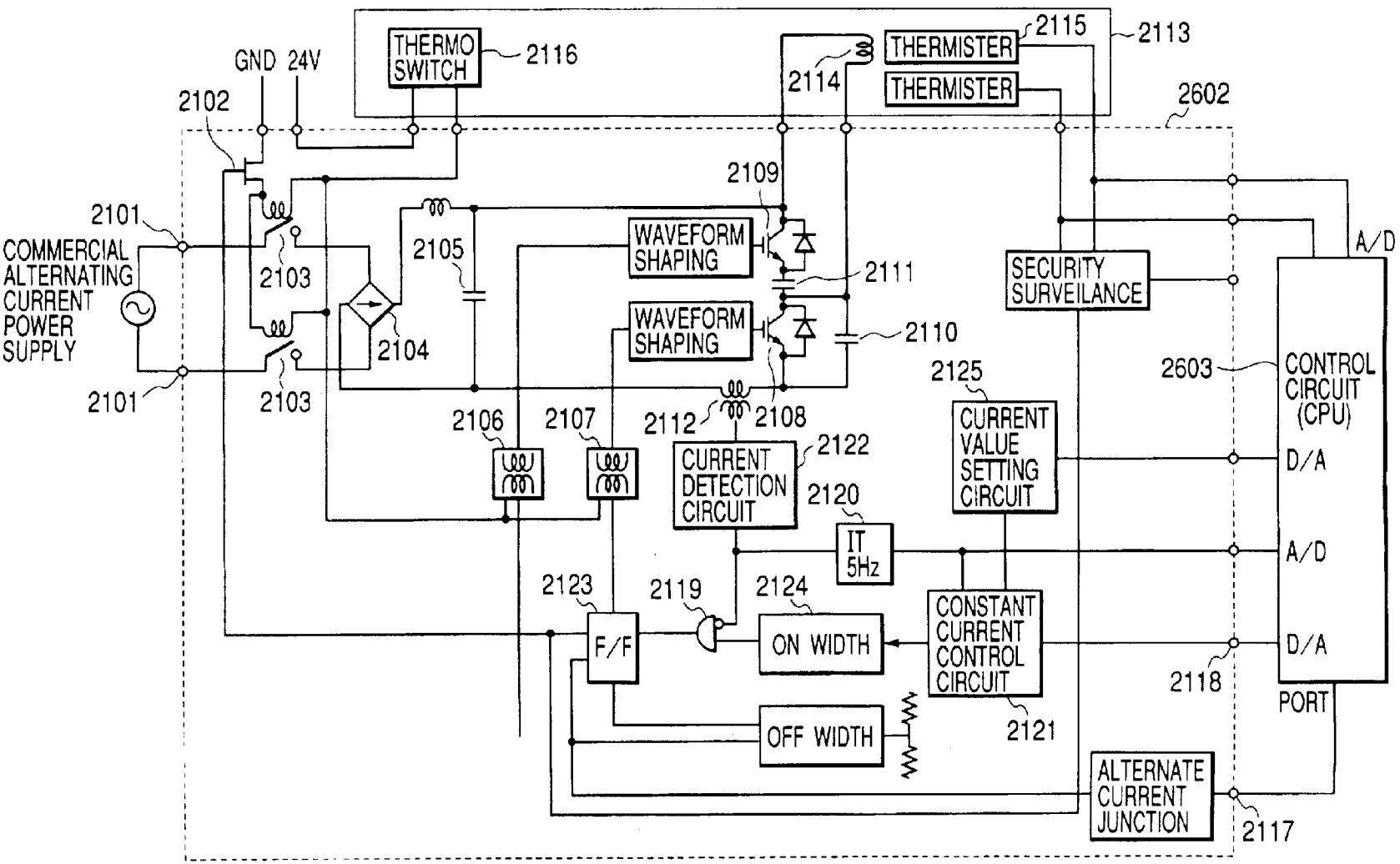
FIG. 15 is a block diagram of a power supply control system.

FIG. 15 is a block diagram of a power supply control system (induction heating inverter apparatus 2602, induction heating fixing apparatus 213, and printer sequence controller 2603) of a fourth embodiment. There are provided a power supply line input terminal 2101, a switching element 2102 for turning on/off a relay 2103, a bridge rectifying circuit 2104 for full-wave rectification, and a capacitor 2105 for high frequency filtering.

There are also provided insulation transformers 2106, 2107 for transmitting a gate wave form, a main switch element 2108, a second (sub) switch element 2109, a resonance capacitor 2110, a second resonance capacitor 2111, and a current transformer 2112 for detecting a switch current switched by the switch elements 2108, 2109.

An induction heating fixing apparatus (fixing unit) 2113 includes, as electric parts, an induction heating coil 2114, a thermistor 2115 and a thermo switch 2116 for detecting an excess temperature.

A heating on/off signal input terminal 2117 of the induction heating fixing apparatus 2113 executes an on/off control of the output of the induction heating inverter apparatus 2602, by a voltage signal transmitted from a printer sequence controller 2603.

A temperature control input terminal 2118 is used to execute a control, based on the temperature detected by the thermistor 2115 of the induction heating fixing apparatus 2113, in comparison with the target temperature.

The switch elements 2108, 2109 are most suitably formed by high-power switching elements and constituted by FETs or IGBTs with inverse conduction diodes. There is preferred a device having a small loss in the stationary state and a small switching loss, in order to suppress the resonance current, and also having a high voltage resistance and a large current capacity.

In response to an AC power supply received by the input terminal 2101 and guided through the thermo switch (excess current breaker) 2116 and the relay 2103 to the bridge rectifying circuit 2104, a pulsating DC voltage is generated by full-wave rectifying diodes.

The main switch element 2108 drives the insulation transformer 2107 for transmitting the gate wave form, so as to execute a switching, whereby an AC pulse voltage is applied to a resonance circuit constituted by the induction heating coil 2114 and the resonance capacitor 2110. As a result, when the main switch element 2108 is rendered conductive, the pulsating DC voltage is applied to the induction heating coil 2114 to generate a current therein, determined by the inductance and the resistance thereof. When the main switch element 2108 is turned off according to the gate signal, as the induction heating coil 2114 tends to continue the current, there is generated, across the induction heating coil 2114, a high voltage which is called a flyback voltage and determined by a sharpness Q of the resonance circuit constituted by the resonance capacitor 2110 and the induction heating coil 2114. This voltage oscillates about the power supply voltage and converges thereto if the off-state is maintained.

In a period where a coil-side terminal of the main switch element 2108 assumes a negative voltage by a large ringing of the flyback voltage, the inverse conductive diode is turned on to introduce a current into the induction heating coil 2114. During such period, the junction of the induction heating coil 2114 and the main switch element 2108 is clamped to 0 V. It is generally known that, in such period, the main switch element 2108 can be turned on without bearing a voltage load, and such switching is known as zero volt switching (ZVS). Such driving method allows to minimize the loss associated with the switching operation of the switch element, and enables a switching operation with a low switching noise.

Japanese Patent Application Laid-open No. 2000-245161 of the present applicant discloses that a power control of an extremely wide control range is possible in a voltage resonance circuit, by turning on a second resonance capacitor 2111 by a second switch element 2109 in a period from a time when the main switch element 2108 is turned off to a time when the main switch element 2108 is turned on. The circuit of the present embodiment is constructed in a similar manner.

Referring to FIG. 15, an AC coupling block is used for realizing a watchdog function by outputting an AC clock signal of about 1 kHz to 200 Hz from the CPU by a software, and, utilizing a fact that such signal is stopped in a runaway state of the CPU, detecting a runaway state of the CPU in the power source circuit 2602 thereby terminating the output.

A safety monitor block monitors the signal from the thermistor by a hardware and deactivates the circuit for example in case of an abnormally high temperature (also in a runaway state of the CPU).

An OFF-width block determines an OFF-width of the main switch (or ON-width of the sub switch) and outputs a fixed value.

An example of the temperature control is shown in the following. There will be explained a case of detecting the temperature with the thermistor 2115, then digitizing the temperature data by the A/D converter and utilizing a digital PID control of a CPU in the printer sequence controller 2603. The thermistor 2115 is provided, in a position at the upstream side of the fixing nip N and opposed to the induction heating coil, in contact with the inner surface of the sleeve. A change in the resistance of the thermistor 2115 is converted by a detection circuit into a voltage which is then compared with a reference voltage, whereby a difference from the target temperature (target voltage) is detected. There is executed a PWM control in which the on-time of the switching element is determined based on the result of such detection.

A PWM control unit is constituted by a constant-current power source circuit, a capacitor and a comparator, each in pairs to form an on-time control unit and an off-time control unit, in each of which a time control is executed by charging the capacitor with a constant current from the constant-current power source circuit and by detecting that the charged voltage exceeds a reference value. During an on-time, the off-time control unit is deactivated in order to prevent an on-operation by an element other than the main switch element 2108, and, during an off-time, the on-time control unit is deactivated. A steering flip-flop repeatedly outputs an on-time of which the time width is controlled in succession, and an off-time. The off-time is maintained constant by a configuration in which the comparator for the off-time is not provided with a feedback loop though it is adjustable, and the input voltage to the comparator for the on-time is made variable to realize the power control with a fixed off-time and a variable on-time.

The CPU of the printer sequence controller 2603 monitors the digital signal, obtained by A/D conversion of the voltage of the thermistor 2115, with a predetermined sampling frequency, and executes a proportional-integration-differential (PID) control including a proportional term, an integrating term and a differentiating term for the difference from the target temperature value. Put more simply, at any sampling operation, there are retained sampling data of at least immediately preceding two sampling operations, and a next control value is determined from the differences of these data from the target value and the change in time of these differences.

Such control value is outputted by the D/A converter, and is entered, through a buffer, into the on-time generating circuit of the inverter circuit. Such circuit compares the charged voltage of the capacitor of the on-time generating circuit with the output value of the D/A converter, and, when the charged voltage of the capacitor becomes higher than the output value of the D/A converter, terminates the on-time and inverts the steering flip-flop thereby initiating an off-time.

In the present embodiment, there is realized a function corresponding to so-called watchdog timer, by outputting, from the control CPU, a fixation permission signal for enabling the fixing operation, constituted by a rectangular wave of a frequency of 500 Hz to 1 kHz, thereby judging whether the CPU is executing the control in the normal state.

A safety apparatus is constructed in the following manner. The circuit receives the AC power from the power supply input terminal 2101 and connects it to the bridge rectifying circuit 2104 through a thermo switch 2116 and a contact of a relay 2103 for excess current protection. An energizing coil of the relay 2103 is powered by a 24V power supply of the main body of the image forming apparatus, through a contact of the thermo switch which is cut off when the detected temperature of the fixing sleeve of the induction heating fixing apparatus 2113 becomes abnormally high beyond a specified temperature. In case the induction heating fixing apparatus 2113 reaches an abnormally high temperature by an eventual trouble, the relay 2103 is cut off the power supply of the energizing circuit, thereby ensuring the safety of the induction heating fixing apparatus 2113 from a thermal runaway state.

In such apparatus, the current control circuit functions in the following manner.

Referring to FIG. 15, the current in the induction heating coil 2114 is detected by the current transformer 2112, then the detected current is rectified by an unrepresented rectifying circuit in the current detection circuit 2122, and is guided through the filter circuit 2120 to detect a current which flows into the resonance circuit formed by the induction heating coil 2114 and the resonance capacitor 2110. The obtained output is compared by an excess current protection circuit 2119 with a predetermined reference value, and, upon detection of a peak current exceeding the reference value, there is executed a limiter function of fixing an output flip-flop (FF) 2123 in an off state, thereby inhibiting the output. The detection of an abnormal current such as a large current present in the circuit, and the protection of the circuit are executed as explained above. The filter circuit 2120 executes a filtering with a lower frequency, to detect an average current flowing in the AC line, and the constant-current control circuit 2121 outputs a voltage corresponding to such average current. Then the output of such average current detection and the temperature control signal entered from the CPU are compared, and either signal providing a smaller electric power is preferentially outputted to the on-width output generation circuit 2124. Therefore, the output of the current detection functions preferentially in case the temperature of the induction heating fixing apparatus 2113 is sufficiently low, while the temperature control signal preferentially functions in case the temperature of the induction heating fixing apparatus 2113 becomes higher to necessitate the temperature control.

In the present embodiment, in order to achieve such selective functions in a simple configuration, the output voltage of the current detection circuit 2122 is used as the control power supply voltage for the current control circuit 2121. Thus, in case the temperature of the induction heating fixing apparatus 2113 is low, there is controlled the maximum value of the control range (maximum chargeable power) based on the result of detection of the AC line current, whereby the maximum suppliable power is made proportional to the AC line voltage.

The current setting by the current setting circuit 2125, constituting the control target of the constant-current control circuit 2121, is rendered variable by the CPU to achieve the power control without requiring the voltage detection circuit.

More specifically, at the function of the motors, the exposure apparatus such as the laser scanner, the high-voltage circuit, the image processing apparatus, the original reading apparatus such as the exposure lamp or the motor, and the like in the image forming apparatus, the current setting by the current setting circuit 2125 for the constant current control circuit 2121 is changed by the CPU to a value matching the function of the various units. Thus, a fixing power, obtained by subtracting the necessary powers in the various units from a suppliable power which is supplied from the image forming apparatus according to the power demand resulting from the operation sequence therein, is supplied as a maximum power of the induction heating fixing apparatus 2113.

In the prior technology, in such case, there has been provided a limit in the maximum value of a D/A output as the temperature control output from the CPU. Such configuration is associated with a drawback that the power, though being controllable, shows a significant fluctuation depending on the AC line voltage (power supply voltage), thus resulting in an extended warm-up time in a region of a lower voltage.

In the image forming apparatus, the electric power is consumed not only in the induction heating fixing apparatus 2113 but also in various mechanisms constituting the image forming apparatus such as a sheet conveying system, an image development system in case of an electrophotographic process, a scanner system for forming a latent image, and a controller for data processing. Also recently an image fetching apparatus is often connected as in a multi-function printer (MFP), and, since the power consumption of the apparatus cannot exceed a predetermined value even when the exposure lamp for original reading or the like is operated, so that the power becomes deficient if the induction heating fixing apparatus 2113 is operated with a constant power. Such problem usually arises not in a continuous printing operation but in a situation where the induction heating fixing apparatus 2113 is in a cold state and requires a maximum power, for example in a first start-up operation in the morning. In such case, the present embodiment allows to reduce the fixing power by about 200 to 600 W without being significantly influenced by the power supply voltage.

Also in the present embodiment, the current setting circuit 2125 is realized by a hardware which divides the reference voltage and the signals from outside of the inverter, such as from the CPU, are rendered variable only in a direction of reducing the power, thereby achieving a fail-safe configuration.

It is also possible, as shown in FIG. 15, to detect the current in the induction heating coil 2114 by the current transformer 2112, and to obtain a current wave form by the current detection circuit 2122. Such current wave form output is detected by the filter circuit 2120 as a peak value of the circuit current, and the constant current control circuit 2121 executes a control to maintain a constant current peak value in the induction heating coil 2114.

In this manner, there is controlled the maximum value (maximum chargeable power) of the control range in case the temperature control is not executed based on the preferential selection of the control signal from the temperature control means 2603 or D/A2 and the result of the current detection as explained in the foregoing, thereby attaining a control in which maximum suppliable power is not dependent on the AC line voltage.

In such configuration, the target value in the aforementioned current control is rendered variable by control means such as a CPU, whereby the maximum suppliable power can be varied by an operation or a power of the image forming apparatus other than in the induction heating fixing apparatus 113 regardless of the power supply voltage.

Also the induction heating inverter apparatuws 2602 can control the power by controlling the on-time with the fixed off-time. In such case, the fixing power increases or decreases respectively by extending or reducing the on-time. The thermistor 2115 is in contact with the fixing sleeve from the internal surface thereof, in a position opposed to the induction heating coil across an insulating holder, and executes temperature detection in a heat fixing position upstream of the fixing nip, in the cross section of the apparatus.

The thermistor is so constructed, through not inllustrated, as to introduce a voltage, obtained by dividing the reference power supply with the detecting resistor, into the CPU, which samples the voltage of the thermistor and executes the temperature control by the aforementioned PID control.

In a cold start situation, the current control values remains at a value indicating the maximum on-time, until the detection output from the filter 2120 of the current control circuit 2121 is stabilized. Also the temperature control signal assumes a value indicating the maximum on-time since the temperature is low. Consequently, the induction heating inverter apparatus 2601 functions with the maximum on-time to execute power supply to the induction heating fixing apparatus 2113. In such period, the maximum power is significantly influenced by the power supply voltage. Also dependence on the temperature is very large. In case the power supply voltage is high, the electric power is supplied without trouble by the function of the current limiter circuits 2122, 2119 provided for protecting the induction heating inverter apparatus 2601. In order to minimize such situation, it is also possible to execute the power supply with a predetermined small power during the initial operation. When the output of the filter is stabilized, the induction heating inverter apparatus 2601 controls the on-time according to either of the current set value and the temperature control signal, indicating a smaller on-width. As the temperature of the induction heating fixing apparatus 2113 is not yet in the temperature controlled state, the control is executed according to the current set value. The current set value is provided by a hardware in the induction heating inverter apparatus 2601, and the control means such as the CPU is rendered to function only in a direction of reducing the on-time, whereby realized is a fail-safe configuration which hardly causes a trouble even in case of a failure in the control. The target voltage of the current set value by the current setting circuit 2125 is changed according to the voltage detected by the thermistor 2115, so as to lower the target current set value when the temperature is low and to return to the voltage value set by the hardware circuit as the temperature increases, whereby realized is a power control with little dependence on the temperature and the voltage.

In the following there will be given an explanation on the temperature dependence. When an electric power is charged into the induction heating fixing apparatus 2113, along with the increase in the temperature of the fixing sleeve 10 and the induction heating coil 2114, the generation state of the eddy current which is the basis of the induction heating is changed principally owing to a temperature dependence of the volume resistivity of the metal, and the amount of energy converted into Joule's heat varies by the change in the resistivity and the penetration depth of the electromagnetic wave. For this reason, even in case the peak value of the current flowing into the induction heating fixing apparatus 2113 and the flyback voltage causing the resonance of the induction heating coil 2114 are controlled constant, the electric power chargeable into the induction heating fixing apparatus 2113 shows an evident temperature dependence.

On the other hand, in the prior configuration, for example a maximum value is provided in the D/A output representing the temperature control signal, and, such configuration outputting a fixed value only shows a significant fluctuation by the voltage. For example, in the on-time control with a fixed off-time as employed in the present embodiment, a fluctuation of the voltage over a range from 100 to 140 V causes a change in the power corresponding to a square of the voltage, namely a change over a range from 1000 to 2000 W.

On the other hand, in the control with a constant current peak value, the change in the power is about 70% of the fluctuation in the voltage, so that a voltage fluctuation over a range from 100 to 140 V only causes a change in the power of about 1000 to 1280 W.

On the other hand, the power change resulting from a temperature change is very large even in the current control, and a temperature change of 25 to 180° C. causes a power change of 1000 to 750 W.

By changing the target value of the current control by the thermistor 2115, it is rendered possible to suppress not only the power variation resulting from the change in the power supply voltage but also that resulting from the temperature change, whereby the power supply to the induction heating fixing apparatus 2113 can be executed in more stable manner.

Also as explained in the foregoing embodiment, the target value of the current control is changed according to the operations of the laser exposure apparatus, the original reading apparatus, the sheet conveying motor etc., thereby enabling smoother operation of the image forming apparatus.

In the present embodiment, the information is transmitted from the CPU to the induction heating inverter apparatus 2601 by analog data obtained in the D/A converter, but the data transfer can naturally be realized in various forms such as by outputting PWM data from the CPU and converting such data into analog data by a filter in the induction heating inverter apparatus 2601.

In the following, there will be explained an example of the fixing apparatus in which the induction heating apparatus of the first to fourth embodiments is applicable.

EXAMPLE OF FIXING APPARATUS

1) FIG. 13A

Figure 13A:
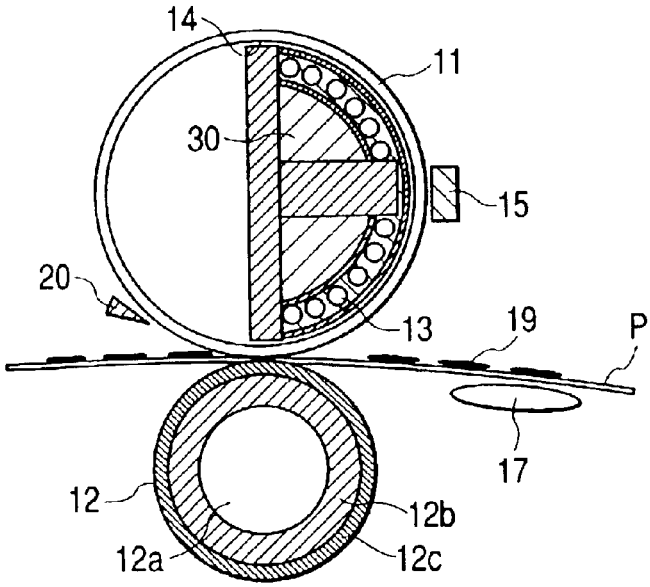
FIG. 13A is a view schematically showing a heat fixing apparatus of the present invention.

FIG. 13A is a schematic view of a heat fixing apparatus for heat fixing an unfixed toner image, formed on a sheet, to such sheet, constituting an induction heating apparatus of any of the foregoing first to third embodiments, wherein a fixing roller 11 (corresponding to the aforementioned rotary heat generating member 104) is formed by an iron cylindrical core on which a PTFE or PFA layer in order to increase the releasing property of the surface. The fixing roller may also be formed by a material of a relatively high magnetic permeability $\mu$ and a suitable resistivity $\rho$, for example a magnetic material (magnetic metal) such as magnetic stainless steel. A non-magnetic material is also usable by forming a thin film of a conductive material such as a metal.

A pressure roller 12, constituting a pressurizing member for directly or indirectly contacting a sheet P with the fixing roller 11, is provided, on an iron core 12*a*, with a silicon rubber layer 12*b* and a surfacial PTFE or PFA releasing layer 12*c* for increasing the releasing property of the surface, as in the fixing roller 11.

The fixing roller 11 and the pressure roller 12 are rotatably supported in a main body of the unrepresented apparatus, wherein the fixing roller 11 alone is driven. The pressure roller 12 is maintained in pressed contact with the surface of the fixing roller 11 and is rotated by a frictional force of a rotary member or a contact portion (nip portion). Also the pressure roller 12 is pressurized by an unrepresented mechanism, for example employing a spring, toward the rotary axis of the fixing roller 11, thereby forming a pressure contact width (nip width). There is provided a temperature sensor 15 (corresponding to the thermistor 123) for detecting the temperature of the fixing roller 11.

A conveying guide 17 is provided in a position for guiding a sheet P, subjected to formation of an unfixed toner image 19 by image forming means (not shown) and conveyed, to a nip portion of the fixing roller 11 and the pressure roller 12. A separating finger 20 is provided in contact with the surface of the fixing roller 11 and serves, in case the sheet P sticks to the fixing roller 11 after passing the nip portion, to forcedly separate the sheet thereby preventing a sheet jamming.

In the present embodiment, the heating member is constituted by the fixing roller, but a configuration formed by a thin metallic film may also be adopted. In the interior of the fixing roller 11, there is provided a coil unit 30 which generates a high frequency magnetic field, in order to induce an induction current (eddy current) in the fixing roller 11 thereby generating Joule's heat.

The coil unit 30 is provided with a core 14 (corresponding to the core member) of a magnetic material, and an induction coil 13 (corresponding to the aforementioned excitation coil 120) for inducing an induction current in the fixing roller 11 for heating. The core 14 is preferably formed by a material of a large magnetic permeability and a small loss, for example ferrite, permalloy or sendast.

2) FIG. 13B

Figure 13B:
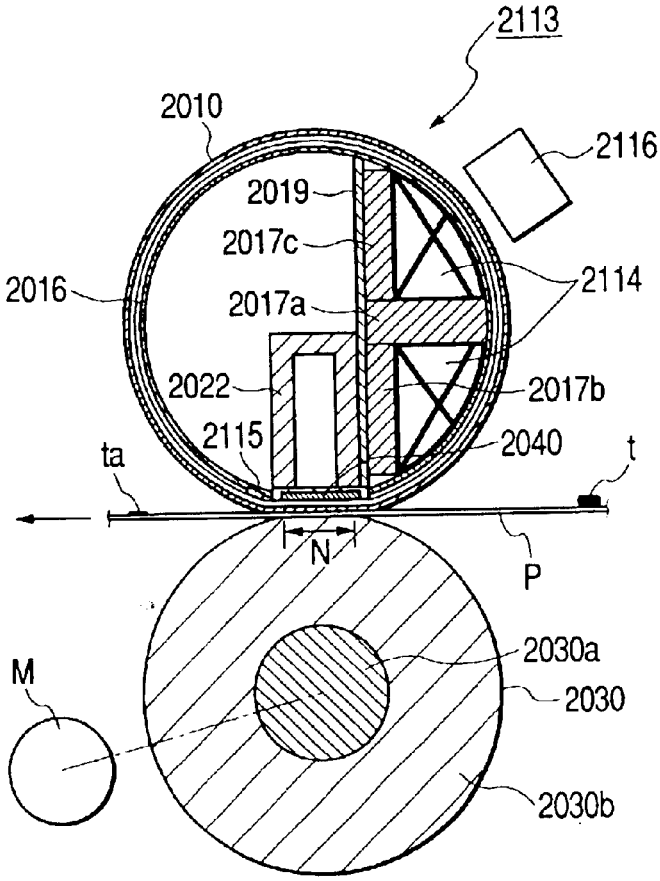
FIG. 13B is a view schematically showing an induction heating fixing apparatus.
Figure 14:
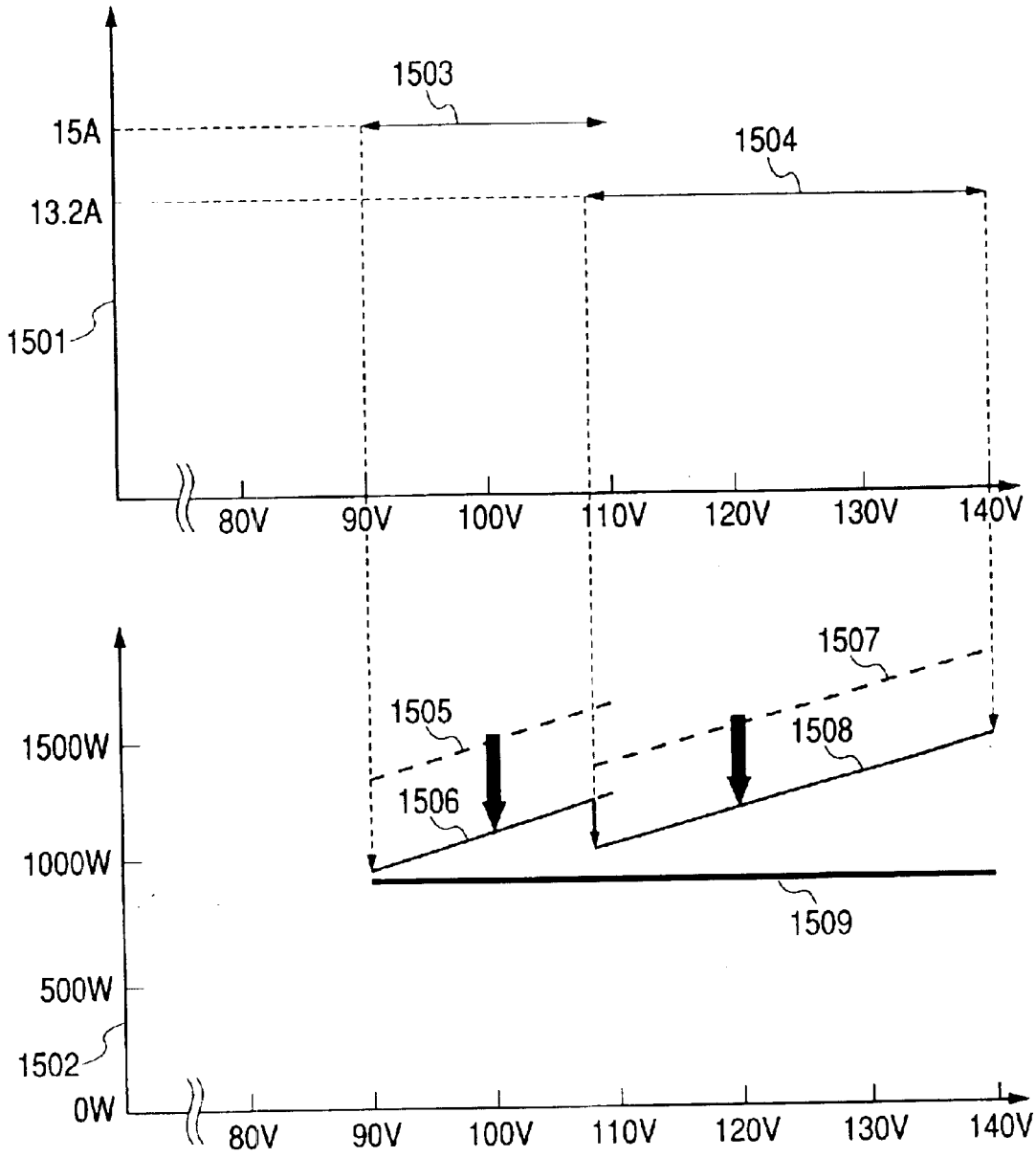
FIG. 14 is a power supply voltage-power characteristic chart showing the relationship between a usable power supply current at 15 A rating and maximum power limiting characteristics in a conventional configuration.

FIG. 13B is a schematic lateral cross-sectional view of the induction heating fixing apparatus 2113 of the present embodiment. This induction heating fixing apparatus 2113 is an apparatus of a pressure roller driven system and an induction heating system, employing a cylindrical fixing sleeve as the electromagnetic induction heating member. Components corresponding to those of the embodiment shown in FIG. 15 are represented by same reference numbers. A cylindrical fixing sleeve 2010 constituting the induction heating member has, in the present embodiment, a composite layer structure including an electromagnetic induction heat generating layer of a metal belt or the like as a base layer, on the external periphery of which an elastic layer and a releasing layer are laminated.

On a cylindrical fixing sleeve guide member 2016, the fixing sleeve 2010 is loosely fitted.

A sliding member 2040 on the internal surface of the fixing sleeve is provided on a lower surface of the guide member 2016, along the longitudinal direction thereof.

An induction heating coil (excitation coil) 2114 and magnetic cores 2017*a*, 2017*b*, 2017*c* forming a T-shaped cross section constitute magnetic flux generating means. The magnetic flux generating means constituted by the induction heating coil (excitation coil) 2114 and the magnetic cores 2017*a*, 2017*b*, 2017*c* is provided in a right half portion, in the drawing, in the fixing sleeve 2010.

There are also provided a pressurizing rigid stay 2022 having a downward open square U-shaped cross section and inserted in the fixing sleeve 2010, and a magnetic flux shielding member (insulating plate) 2019 provided between the magnetic flux generating means 2114, 2017*a*, 2017*b*, 2017*c* and the pressurizing rigid stay 2022.

A thermistor 2115 constituting temperature detection means for detecting the temperature of the fixing sleeve

2010 is positioned on the external surface of a fixing sleeve guide member 2016 at the downstream side of the sliding member 2040 in the rotating direction of the fixing sleeve.

A thermo switch (excess current breaker) 2116 serving as an electric safety apparatus is provided close to the external surface of the fixing sleeve 2010, at the side of the magnetic flux generating means 2114, 2017*a*, 2017*b*, 2017*c*.

An elastic pressure roller 2030 is constituted by a metal core 2030*a*, and a heat resistant elastic layer 2030*b*. The pressure roller 2030 is rotatably supported, at both ends of the metal core 2030*a*, between unrepresented side plates of the apparatus.

Above the pressure roller 2030, an assembly of the fixing sleeve 2010, the guide member 2016, the slidable member 2040, the magnetic flux generating means 2114, 2017*a*, 2017*b*, 2017*c*, the pressurizing rigid stay 2022, the magnetic flux shield member 2019, the thermistor 2115 etc. is positioned parallel to the pressure roller 2030 with the slidable member 2040 at the lower surface of the guide member 2016, and the both ends of the pressurizing rigid stay 2022 are pressed down with unrepresented pressurizing springs to attain a pressurized state, whereby the slidable member 2040 on the lower surface of the guide member 2016 is pressed to the upper surface of the pressure roller 2030 across the fixing sleeve 2010 and against the elasticity of the heat resistant elastic layer 2030*b* under a predetermined pressing force, thereby forming a fixing nip N of a predetermined width.

The pressure roller 2030 is rotated by a driving motor M in a counterclockwise direction indicated by an arrow. A rotating force is applied to the fixing sleeve 2010 by a frictional force between the external surface thereof and the rotated pressure roller 2030, whereby the fixing sleeve 2010 is rotated along the periphery of the guide member 2016 in a clockwise direction indicated by an arrow, in contact with and sliding over the lower surface of the slidable member 2040 and with a peripheral speed substantially same as the rotation peripheral speed of the pressure roller 2030.

An induction heating inverter apparatus 2601 supplies the induction heating coil 2114 of the magnetic field generation means with an electric power (high frequency current) to generate an AC magnetic flux. The magnetic cores 2017*a*, 2017*b*, 2017*c* efficiently guide the magnetic field, generated from the induction heating coil 2114, to the fixing sleeve 2010 constituting the heat generating member. an eddy current is induced in the induction heat generating layer constituting the base layer of the fixing sleeve 2010 by the AC magnetic flux acting thereon, and generates Joule's heat by the specific resistance of the induction heat generating layer, thereby the fixing sleeve 2010 generates heat. The temperature rise caused by the above-mentioned heat generation of the fixing sleeve 2010 is detected by the thermistor 2115 constituting the temperature detection means in contact with the internal surface of the induction heat generating layer of the fixing sleeve 2010, and the detected temperature information is fed back to the induction heating inverter apparatus 2601. The induction heating inverter apparatus 2601 controls, by the printer sequence controller 2603, the power supply to the induction heating coil 2114 so as to maintain the fixing sleeve 2010 at a predetermined temperature, whereby the fixing nip N is controlled at the predetermined fixing temperature.

In a state where the fixing sleeve 2010 is rotated and the power supply from the induction heating inverter apparatus 2601 to the induction heating coil 2114 to execute induction heating of the fixing sleeve 2010 thereby heating and maintaining the fixing nip N at the predetermined temperature, the recording material P conveyed from the image forming means and bearing the unfixed toner image t is introduced in the fixing nip N between the fixing sleeve 2010 and the pressure roller 2030 with the image bearing surface upward, namely facing the external surface of the fixing sleeve 2010, and is conveyed through the fixing nip N in state pinched therein and in close contact with the external surface of the fixing sleeve 2010.

The recording material P, in the course of pinched conveying through the fixing nip N, is heated by the induction generated heat of the fixing sleeve 2010 whereby the unfixed toner image on the recording material P is fixed by heat. After passing the fixing nip N, the recording material P is separated from the external surface of the rotary fixing sleeve 2010 and conveyed for discharge. The heat fixed toner image on the recording material P is cooled, after passing the fixing nip, to constitute a permanently fixed image ta.

The thermo switch 2116 serves as a safety apparatus for emergency cut-off of the power source circuit upon detecting an overheated state of the fixing sleeve 2010 beyond a predetermined permissible temperature by a thermal runaway of the apparatus.

EXAMPLE OF IMAGE FORMING APPARATUS

In the following there will be explained an example of the image forming apparatus in which the induction heating apparatus or the fixing apparatus of the foregoing embodiments.

Figure 16:
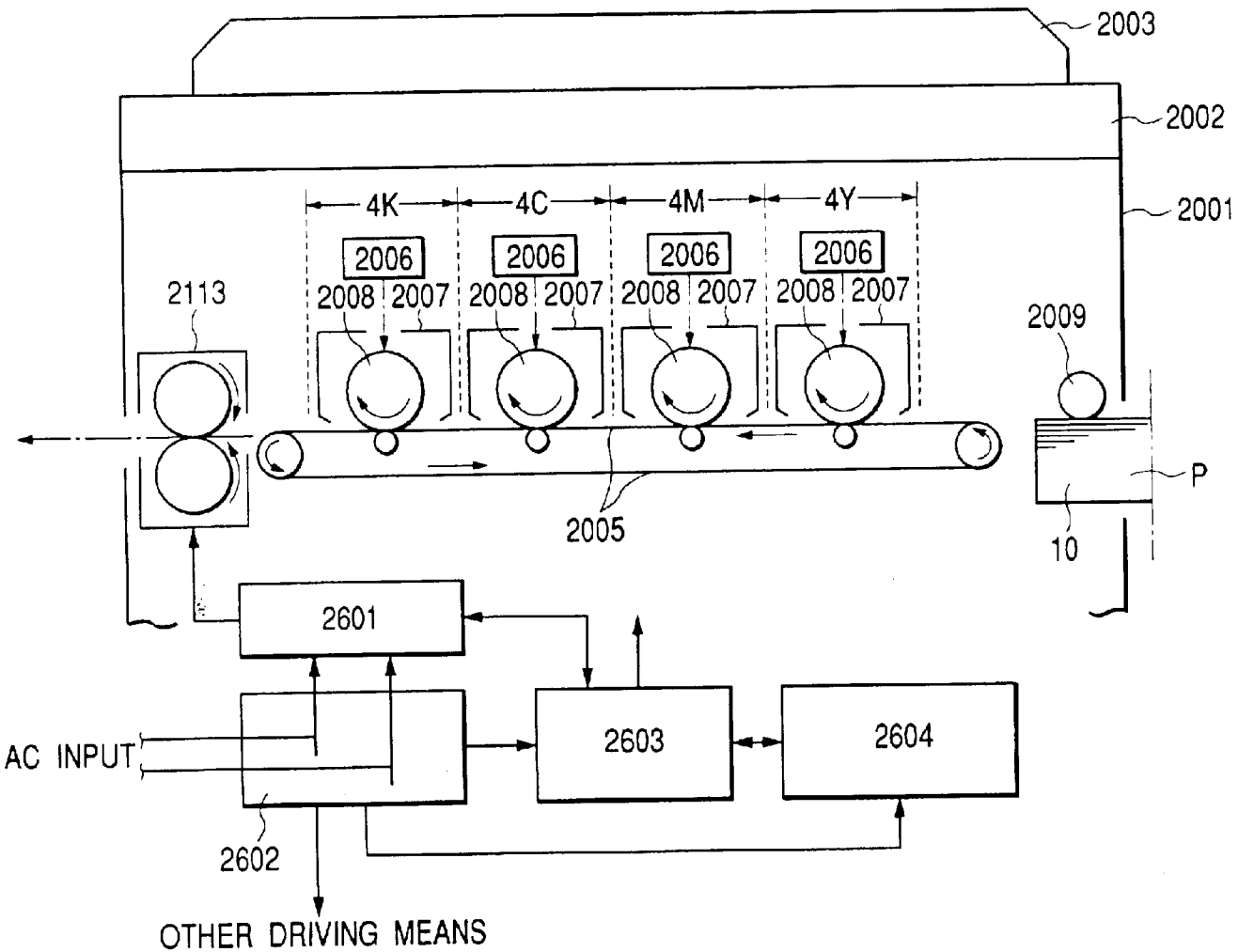
FIG. 16 is a schematic view of an image forming apparatus.

FIG. 16 is a schematic view showing the configuration of an image forming apparatus in which the present invention can be advantageously applied, and which is a tandem color laser printer utilizing an electrophotographic process.

There are shown a main body (printer main body) 2001 of the image forming apparatus, an original reading apparatus (color image reader) 2002 mounted on the main body 2001, and an automatic document feeding apparatus (ADF or RDF) 2003 mounted on the original reading apparatus 2002, and serving to automatically feed originals thereto. The original reading apparatus 2002 photoelectrically read and process the original image. A color image original is subjected to photoelectric reading with color separation.

In the main body 2001 of the image forming apparatus, first to fourth image processing apparatuses 2004Y, 2004M, 2004C, 2004K are provided in succession from the right to the left, above the upper side of an endless conveyor belt 2005 provided in substantially horizontally in the lateral direction.

Each of the image processing apparatuses 2004Y, 2004M, 2004C, 2004K is an electrophotographic process mechanism 2007 including a laser scanner 2006 as an exposure apparatus. The electrophotographic process mechanism 2007 includes a rotary photosensitive drum 2008 and is further provided with image process devices such as a charging apparatus, a developing apparatus, a cleaning apparatus etc. which are omitted from the illustration.

The first image processing apparatus 2004Y forms a yellow toner image, corresponding to a yellow component of the color image, on the photosensitive drum 2008. The second image processing apparatus 2004M forms a magenta toner image, corresponding to a magenta component of the color image, on the photosensitive drum 2008. The third image processing apparatus 2004C forms a cyan toner image, corresponding to a cyan component of the color image, on the photosensitive drum 2008. The fourth image processing apparatus 2004K forms a black toner image on the photosensitive drum 2008.

The recording material conveyor belt 2005 is rotated in a counterclockwise direction indicated by an arrow, and conveying a recording material (transfer material) P separated and fed by a feeding roller 2009 from a sheet cassette 2010, conveys the recording material in succession to transfer portions of the first to fourth image processing apparatuses 2004Y, 2004M, 2004C, 2004K. The conveyed recording material P receives a transfer of the yellow toner image from the photosensitive drum 2008 in the transfer portion of the first image processing apparatus 2004Y, a transfer of the magenta toner image from the photosensitive drum 2008 in the transfer portion of the second image processing apparatus 2004M, a transfer of the cyan toner image from the photosensitive drum 2008 in the transfer portion of the third image processing apparatus 2004C, and a transfer of the black toner image from the photosensitive drum 2008 in the transfer portion of the fourth image processing apparatus 2004*k*, in succession and in superposed manner. In this manner a color toner image is synthesized on the surface of the recording material P.

The recording material P, bearing thus synthesized color toner image, is separated from the conveyor belt 2005, then is introduced into the induction heating fixing apparatus (fixing unit) 2113 for heat fixation of the color toner image, and is discharged from the main body of the image forming apparatus.

In case of a monochromatic mode, the image forming operation is executed only by the fourth image processing apparatus 2004K for forming the black toner image.

There are also provided a power source circuit 2602 receiving a commercial AC power supply and supplying various units of the image forming apparatus with the electric power, and a printer sequence controller 2603. An induction heating coil of the induction heating fixing apparatus 2113 receives power supply from the power source circuit 2602 through an induction heating inverter apparatus (IH inverter apparatus) 2601. A block 2604 collectively includes drive/control means for the image forming apparatuses.

(Other Embodiments)

The above-described embodiments are mere examples, and the maximum power set/control means utilizes the peak value of the excitation current which is advantageous in linearity, but it is also possible to detect the effective current. Also instead of detecting the excitation current, there may be employed other means for arbitrarily setting the maximum power according to the voltage, and, for example in a configuration of directly measuring the commercial power supply voltage as in the prior example 1, there may be provided means for detecting the power supply voltage and correcting the power for setting the correction value for the power control signal according to the detected voltage thereby achieving an arbitrary maximum power setting according to the power supply voltage. It is naturally possible also, in a configuration of detecting the voltage and current of the commercial power supply voltage and determining the power consumption from such voltage and current data as in the prior example 2, there may be provided means for detecting the power supply voltage and correcting the power for setting the correction value for the power control signal according to the detected voltage thereby achieving an arbitrary maximum power setting according to the power supply voltage, though the cost is naturally higher in such case.

Also all the foregoing embodiments have been explained by an induction heating fixing apparatus utilizing a voltage-resonance inverter power source and by an on-time control with a fixed off-time. However there may also be employed another control method, such as a duty control, a frequency control or an off-time control, and the inverter apparatus is not limited to the voltage resonance type but may be another type such as a partial resonance type or a current resonance type.

It is to be understood that the form of the invention herein shown and described is to be taken as a preferred example of the same and that various changes in the shape, size and arrangement of parts may be resorted to without departing from the spirit of the invention or the scope of the subjoined claims.

What is claimed is:

1. An image forming apparatus which is capable of receiving either of a first and a second commercial power supply, each of the commercial power supplies having a different rated voltage, comprising:

an image forming unit which forms an unfixed toner image on a sheet;

a heat fixing unit which conveys under pressure a sheet bearing an unfixed toner image thereon for heat fixing said unfixed toner image to said sheet, said heat fixing unit including a rectifying circuit for rectifying a commercial power supply, an inverter power source circuit having an excitation coil receiving a high frequency current for induction heating a heat generating member, and a switching element for supplying said excitation coil with the high frequency current utilizing the output of said rectifying circuit; and a controller which controls a switching timing of said switching element in order to vary an output of said inverter power source circuit, wherein said controller limits a maximum output of said inverter power source circuit such that, in the case that a commercial power supply as a power supply source is said first commercial power supply, a consumption power of the image forming apparatus is a proximity of a power corresponding to a rated suppliable maximum current of the first commercial power supply at least under a certain condition, and in the case that a commercial power supply as a power supply source is said second commercial power supply, a consumption power of the image forming apparatus is a proximity of a power corresponding to a rated suppliable maximum current of the second commercial power supply at least under a certain condition.

2. An image forming apparatus according to claim 1, further comprising:

a heat generating member temperature detector;

wherein said controller controls said switching timing, based on a detected temperature of said heat generating member temperature detector, in such a manner that the temperature of said heat generating member converges to a target temperature.

3. An image forming apparatus according to claim 2, further comprising:

excitation current detector which detects a current passing in the excitation coil;

wherein said controller limits the maximum output based on a value detected by said excitation current detector and a reference value of the excitation current.

4. An image forming apparatus according to claim 1, further comprising:

excitation current detector which detects a current passing in the excitation coil;

wherein said controller limits the maximum output based on an excitation current detected by said excitation current detection when said switching element is switched with a predetermined frequency and a predetermined current supply time.

5. An image forming apparatus according to claim 1, wherein said controller limits the maximum output so that a consumption power of the image forming apparatus is a proximity of a power corresponding to a rated suppliable maximum current of the commercial power supply as a power supply source in the case that a consumption power of units except said heat fixing unit is maximum, and the commercial power supply voltage is at a lower limit of an operation voltage range.

6. An image forming apparatus according to claim 1, wherein said controller includes a power supply voltage detector which detects a commercial power supply voltage and limits the maximum output, based on the detected commercial power supply voltage.

7. An image forming apparatus according to claim 1, wherein said controller includes a power supply voltage detector which detects a commercial power supply voltage and power supply current detector which detects a current from the commercial power supply, and limits the maximum output, based on the detected commercial power supply voltage and the detected commercial power supply current.

8. An image forming apparatus according to claim 1, further comprising:

a heat generating member temperature detector;

wherein said controller includes a temperature controller which outputs a first control signal according to a value detected by said temperature detector and a maximum power limiter which outputs a second control signal, the first and second control signals corresponding to the same power when the first control signal corresponding to a power less than the maximum power, and the second control signal corresponds to the maximum power when the first control signal corresponds to a power more than the maximum power.

9. An image forming apparatus according to claim 1, wherein said image forming unit forms an unfixed toner image having a plurality of color components on a sheet.

10. An image forming apparatus according to claim 9, wherein said image forming unit includes a plurality of image forming stations, each of which forms a color component image to be superposed respectively.

11. An image forming apparatus comprising:

an image forming unit which forms an unfixed toner image on a sheet;

a heat fixing unit which conveys under pressure a sheet bearing an unfixed toner image thereon for heat fixing the unfixed toner image to the sheet, said heat fixing unit including a rectifying circuit for rectifying a commercial power supply, an inverter power source circuit having an excitation coil receiving a high frequency current for induction heating a heat generating member, and a switching element for supplying said excitation coil with the high frequency current utilizing the output of said rectifying circuit; and a controller which controls operations of units in said image forming apparatus, wherein said controller controls a switching timing of said switching element in order to vary an output of said inverter power source circuit and limits maximum output of said inverter power source circuit according to an operation state of at least a unit in said image forming apparatus other than said heat fixing unit and a voltage of the commercial power supply.

12. An image forming apparatus according to claim 11, further comprising:

a heat generating member temperature detector;

wherein said controller controls said switching timing, based on a detected temperature of said heat generating member temperature detector, in such a manner that the temperature of said heat generating member converges to a target temperature.

13. An image forming apparatus according to claim 11, further comprising:

an excitation current detector which detects a current passing in the excitation coil;

wherein said controller limits the maximum output based on a value detected by said excitation current detector and a reference value of the excitation current.

14. An image forming apparatus according to claim 11, further comprising:

an excitation current detector which detects a current passing in the excitation coil;

wherein said controller limits the maximum output based on an excitation current detected by said excitation current detector when said switching element is switched with a predetermined frequency and a predetermined current supply time.

15. An image forming apparatus according to claim 11, wherein said heat fixing unit further includes:

a heat generating member temperature detector;

wherein said controller controls said switching timing, in such a manner that the maximum output is set according to a value detected by said temperature detection means, an operation state of at least a unit executing an image forming operation other than heating in the induction heat fixing, and the commercial power supply voltage.

16. An image forming apparatus according to claim 11, wherein said controller includes a power supply voltage detector which detects a commercial power supply voltage and limits the maximum output based on the detected commercial power supply voltage.

17. An image forming apparatus according to claim 11, wherein said controller includes a power supply voltage detector which detects a commercial power supply voltage and power supply current detector which detects a current from the commercial power supply, and limits the maximum output based on the detected commercial power supply voltage and the detected commercial power supply current.

18. An image forming apparatus according to claim 11, further comprising:

a heat generating member temperature detector;

wherein said controller includes a temperature controller which outputs a first control signal according to a value detected by said temperature detector and a maximum power limiter which outputs a second control signal, the first and second control signals corresponding to the same power when the first control signal corresponds to a power less than the maximum power, and the second control signal corresponding to the maximum power when the first control signal corresponds to a power more than the maximum power.

19. An image forming apparatus according to claim 11, wherein said image forming unit forms an unfixed toner image having a plurality of color components on a sheet.

20. An image forming apparatus according to claim 19, wherein said image forming unit includes a plurality of image forming stations, each of which forms a color component image to be superposed respectively.

21. An image forming apparatus which is capable of receiving either of a first and a second commercial power supply each having a different rated voltage, comprising:

an image forming unit which forms an unfixed toner image on a sheet;

a heat fixing unit which conveys under a pressure a sheet bearing an unfixed toner image thereon for heat fixing said unfixed toner image to said sheet; and a controller which controls a power supplied to said heat fixing unit, wherein said controller limits a maximum power supplied to said heat fixing unit such that, in the case that a commercial power supply as a power supply source is said first commercial power supply, a consumption power of the image forming apparatus is a proximity of a power corresponding to a rated suppliable maximum current of the first commercial power supply at least under a certain condition, and in the case that a commercial power supply as a power supply source is said second commercial power supply, a consumption power of the image forming apparatus is a proximity of a power corresponding to a rated suppliable maximum current of the second commercial power supply at least under a certain condition.

22. An image forming apparatus according to claim 21, further comprising:

a heat fixing unit temperature detector, wherein said controller controls a power supplied to said heat fixing unit, based on a detected temperature of said heat fixing unit temperature detector, in such a manner that the temperature of said heat fixing unit converges to a target temperature.

23. An image forming apparatus according to claim 21, wherein said controller limits the maximum power so that a consumption power of the image forming apparatus is a proximity of a power corresponding to a rated suppliable maximum current of the commercial power supply as a power supply source in the case that a consumption power of units except said heat fixing unit is maximum, and the commercial power supply voltage is at a lower limit of an operation voltage range.

24. An image forming apparatus according to claim 21, wherein said controller includes power supply voltage detector which detects a commercial power supply voltage and limits the maximum power based on the detected commercial power supply voltage.

25. An image forming apparatus according to claim 21, wherein said controller includes power supply voltage detector which detects a commercial power supply voltage and power supply current detector which detects a current from the commercial power supply, and limits the maximum power based on the detected commercial power supply voltage and the detected commercial power supply current.

26. An image forming apparatus according to claim 21, further comprising:

a heat fixing unit temperature detector, wherein said controller includes a temperature controller which outputs a first control signal according to a value detected by said temperature detector and a maximum power limiter which outputs a second control signal, the first and second control signals corresponding to the same power when the first control signal corresponding to a power less than the maximum power, and the second control signal corresponds to the maximum power when the first control signal corresponds to a power more than the maximum power.

27. An image forming apparatus according to claim 21, wherein said image forming unit forms an unfixed toner image having a plurality of color components on a sheet.

28. An image forming apparatus according to claim 27, wherein said image forming unit includes a plurality of image forming stations, each of which forms a color component image to be superposed respectively.

* * * * *

UNITED STATES PATENT AND TRADEMARK OFFICE

CERTIFICATE OF CORRECTION

PATENT NO. : 6,930,293 B2
DATED : August 16, 2005
INVENTOR(S) : Shimpei Matsuo et al.

It is certified that error appears in the above-identified patent and that said Letters Patent is hereby corrected as shown below:

Column 7,
Line 36, “the set value of” should be deleted.

Column 10,
Line 21, “an” should read -- a --.

Column 20,
Line 3, “apparatuws” should read -- apparatus --.

Signed and Sealed this

Seventeenth Day of January, 2006

JON W. DUDAS
*Director of the United States Patent and Trademark Office*